US009099017B1

(12) United States Patent
Pentland

(10) Patent No.: US 9,099,017 B1
(45) Date of Patent: Aug. 4, 2015

(54) FALLING PATTERN IMAGERY SYSTEM

(71) Applicant: Joseph C. Pentland, Bridgeport, CT (US)

(72) Inventor: Joseph C. Pentland, Bridgeport, CT (US)

( * ) Notice: Subject to any disclaimer, the term of this patent is extended or adjusted under 35 U.S.C. 154(b) by 0 days.

(21) Appl. No.: 14/162,474

(22) Filed: Jan. 23, 2014

Related U.S. Application Data

(60) Provisional application No. 61/755,729, filed on Jan. 23, 2013.

(51) Int. Cl.
*G09F 19/02* (2006.01)

(52) U.S. Cl.
CPC ..... *G09F 19/02* (2013.01)

(58) Field of Classification Search
CPC ..... G09F 19/02
USPC ..... 40/409
See application file for complete search history.

(56) References Cited

U.S. PATENT DOCUMENTS

| | | | | | |
|---|---|---|---|---|---|
| 3,775,883 | A * | 12/1973 | Atkins | 40/409 |
| 3,782,729 | A * | 1/1974 | Ernst | 273/138.2 |
| 5,426,877 | A * | 6/1995 | Lin | 40/406 |
| 5,919,078 | A * | 7/1999 | Cassidy | 446/479 |
| 6,153,273 | A * | 11/2000 | Lee Lin | 428/13 |
| 2002/0106249 | A1 * | 8/2002 | Lin | 406/106 |
| 2012/0174446 | A1 * | 7/2012 | Ruiz | 40/409 |

* cited by examiner

*Primary Examiner* — Gary Hoge
(74) *Attorney, Agent, or Firm* — Drinker Biddle & Reath LLP

(57) ABSTRACT

An apparatus for dropping multiple objects into a visual field to create imagery including hollow ducts for conveying the objects to the visual field and computer-controlled gating devices for releasing the objects at desire times and sequences to produce the imagery.

19 Claims, 27 Drawing Sheets

FALLING PATTERN IMAGERY SYSTEM

CROSS-REFERENCE TO RELATED PATENT APPLICATIONS

This patent application claims the benefit of U.S. Provisional Patent Application No. 61/755,729, filed Jan. 23, 2013.

FIELD OF THE INVENTION

This invention relates generally to moving multiple objects in a space and, more particularly, to methods and apparatus for synchronously dropping multiple objects in space in unique new ways to create novel imagery including stationary and dynamic abstract and manifest images.

BACKGROUND OF THE INVENTION

From almost the inception of kinetic art, people have been interested in moving objects in space in order to create visual effects relying on human, solar, wind, or magnetic powered motion. For most of the twentieth century such kinetically produced art has been limited primarily to single speed objects moving on rudimentary trajectories. And, while more complex kinetically produced art became possible when transmissions could be used to vary speed, most contemporary kinetically produced art has been limited to moving objects at a discreet small number of speeds on relatively simple trajectories.

SUMMARY

This invention comprises a system for creating unique imagery by synchronously dropping multiple recirculating objects in space to produce abstract and manifest images. "Abstract images" in this context are images whose content depends solely on intrinsic form. "Manifest images" in this context are apparent images that the viewer can see, recognize and understand, such as letters, words, geometrical images, and images of recognizable things.

The objects used in this system to kinetically produce imagery including abstract and manifest images are referred to as "visual field objects" because they are used to produce imagery within a viewer's visual field. Embodiments preferably use visual field objects that are spherical because their uniform symmetry simplifies the release and recirculation of the visual field objects within the system, without regard to how the spherical visual field objects are oriented as they move through the system. However, although more complex the field object shapes require more complex return mechanisms, any regular or irregular shape can be used as a field object. For example, cubes 36*f* (FIG. 15), cylinders 36*g* (FIG. 15), pyramids 36*h* (FIG. 15), toruses 36*i* (FIG. 15), hemispheres 36*j* (FIG. 15), prisms 36*k* (FIG. 15), star-shapes 361 (FIG. 15), pill shapes 36*m* (FIG. 15) and cone shapes 36*n* (FIG. 15) may be used.

The visual field objects may be solid or hollow, and made of metal, plastic, wood, rubber, glass, foam, or other appropriate material. For example, visual field objects in the form of high density polyethylene spheres of a diameter of less than about 1 inch to greater than about 12 inches may be used with a range of about 4 to 8 inches currently being preferred. Preferably, the weight of the spheres will be chosen or adjusted as appropriate for a particular application. For example, where air currents are present, the spheres should be heavy enough to fall generally vertically, without being diverted by the air currents. On the other hand, since heavier spheres (and other shaped visual field objects) will be more difficult to recirculate, their weight should be adjusted to avoid placing undue stress on the recirculating system. When lightweight materials like foam are used, an appropriate weight may be located within the visual field objects. When resilient material like rubber is used and a hard surface is located at the bottom of the visual field, the visual objects will bounce when they hit this hard surface, adding interest to the resulting imagery. The timing and height of the bounces produced can be controlled by controlling the velocity and positioning of the dropping visual field objects.

Finally, both the abstract and the manifest images may be in either linear three-dimensional form or full three-dimensional form. Images in "linear three-dimensional form" are images generated generally in a plane or without depth, but comprised of three-dimensional visual field objects which themselves are three-dimensional. Images in "full three-dimensional form" are images generated by field image objects disposed in three dimensions or having an extension in depth.

BRIEF DESCRIPTION OF THE DRAWINGS

In order to aid in understanding the invention, it will now be described in connection with exemplary embodiments thereof with reference to the accompanying drawings in which like numerical designations will be given to like features with reference to the accompanying drawings wherein.

DETAILED DESCRIPTION OF THE INVENTION

The embodiments of the invention described below are not intended to be exhaustive or to limit the invention to the precise structures and operations disclosed. Rather, the described embodiments have been chosen to explain the principles of the invention and its application, operation and use in order to best enable others skilled in the art to follow its teachings.

Figure 1:
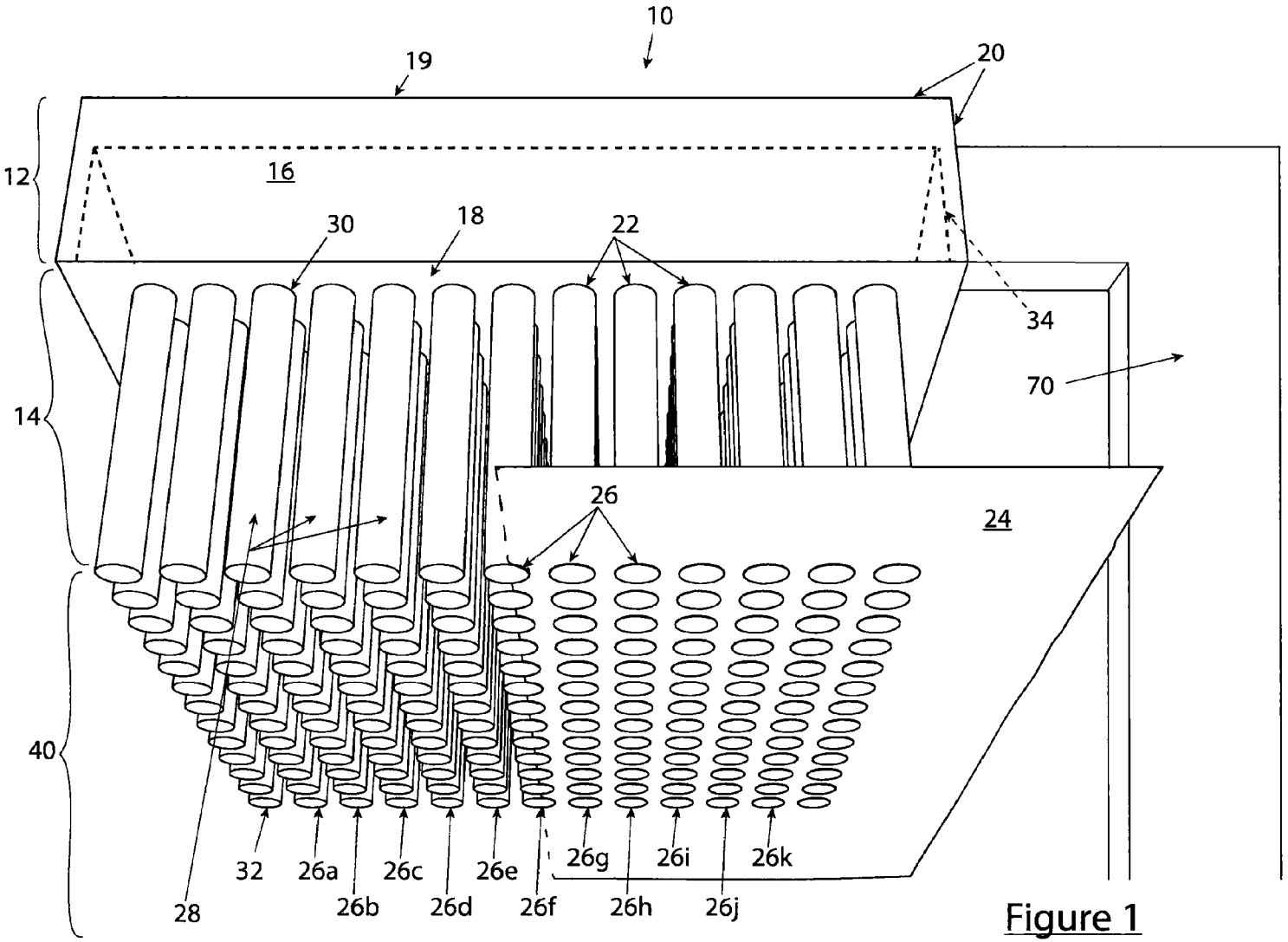
FIG. 1 is a partial perspective view of an embodiment of the apparatus of the invention.

Referring to FIG. 1, a falling pattern imagery system embodiment 10 is illustrated including an upper section 12, a lower section 14, and a visual field 40. Upper section 12 includes a rectangular hopper 16 having a bottom panel 18 and sidewalls 20 about the perimeter of the hopper. The top 21 of the hopper is open and a plurality of apertures 22 are distributed across the bottom panel of the hopper.

Figure 2A:
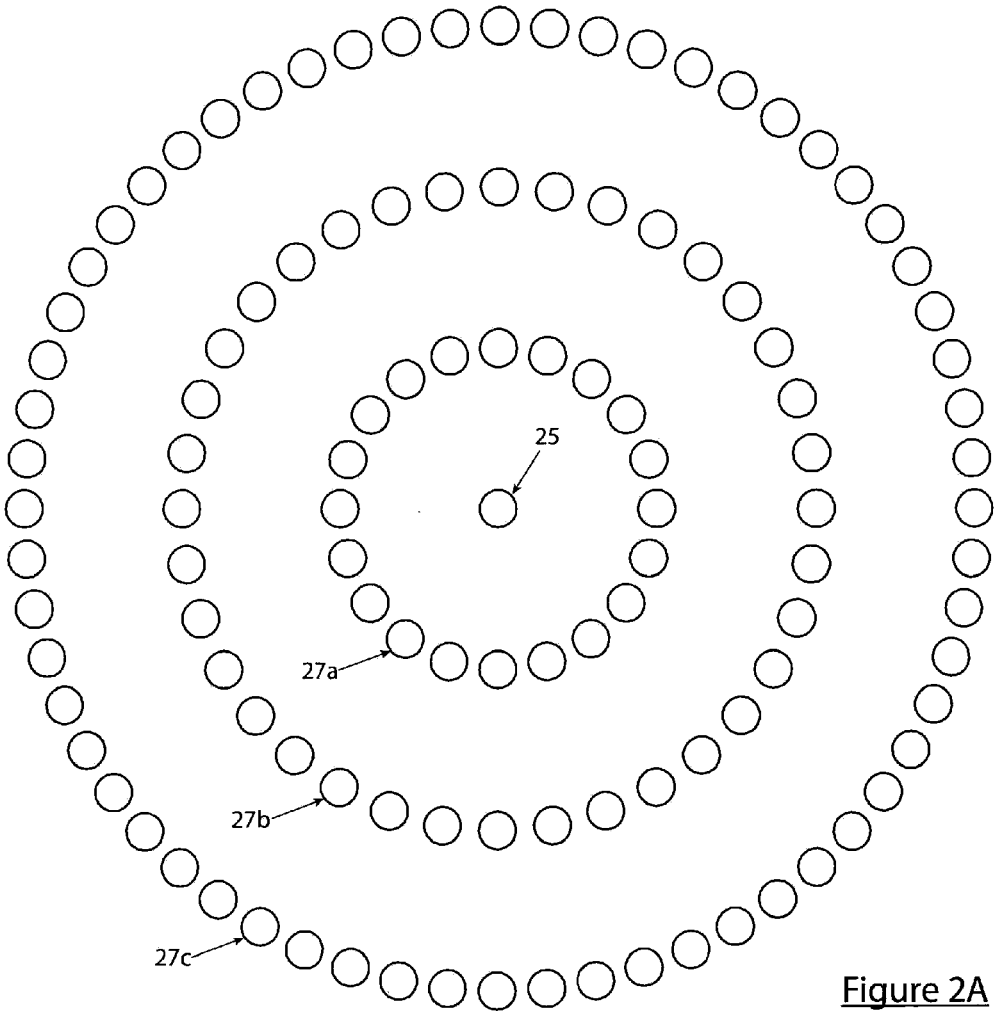
FIG. 2A illustrates a ceiling aperture configuration including a central aperture and concentric circles of apertures.

While only a single aperture 22 need be present in the bottom panel, preferably the bottom panel will include a plurality of apertures. The apertures may be arranged in a random configuration or in an orderly configuration which may be a geometric shape, a regular or irregular matrix, an outline of a visual object, etc. If, for example, the may be arranged in a geometric shape with a central aperture 25 and concentric circles of apertures 27A-27C of FIG. 2A. Visual field objects may be dropped from the apertures in patterns that advance along the circles to produce dropping helical shapes by sequentially dropping visual field objects from central aperture 25, then sequentially through the apertures of Circle 27*a*, then sequentially through the apertures of concentric circle 27*b* and finally sequentially through the apertures of circle 27*c*.

Figure 2B:
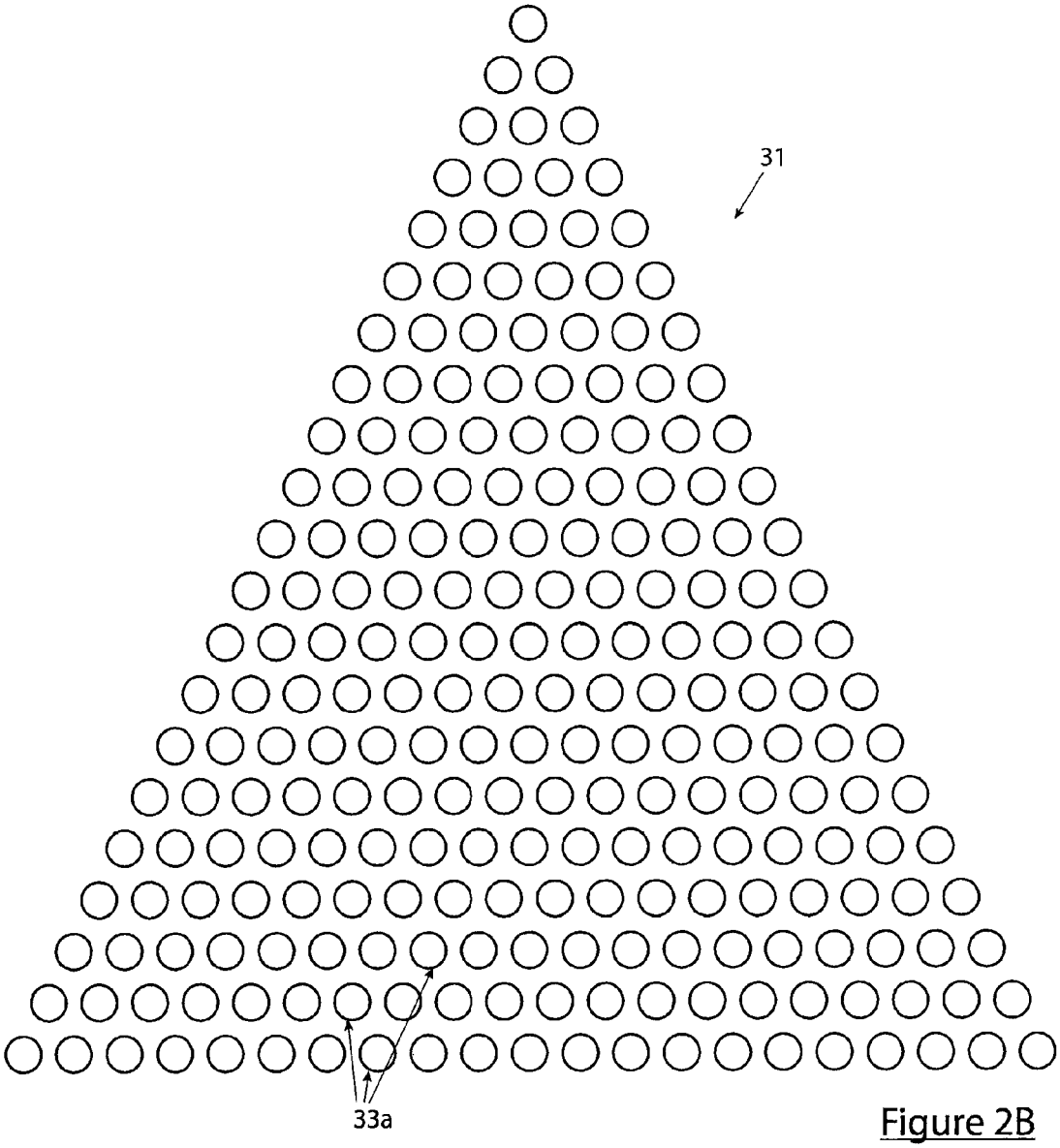
FIG. 2B illustrates a ceiling aperture configuration in which the apertures are ranged triangularly.

FIG. 2B illustrates an embodiment comprising a ceiling aperture configuration 31 in which apertures 33 are ranged triangularly. Thus, for example, if visual field objects were dropped simultaneously or sequentially from the apertures 33*a* along the periphery of the triangular image, a fully three-dimensional manifest image of a triangular prism extending from the top to the bottom of the visual field could be produced.

Figure 2C:
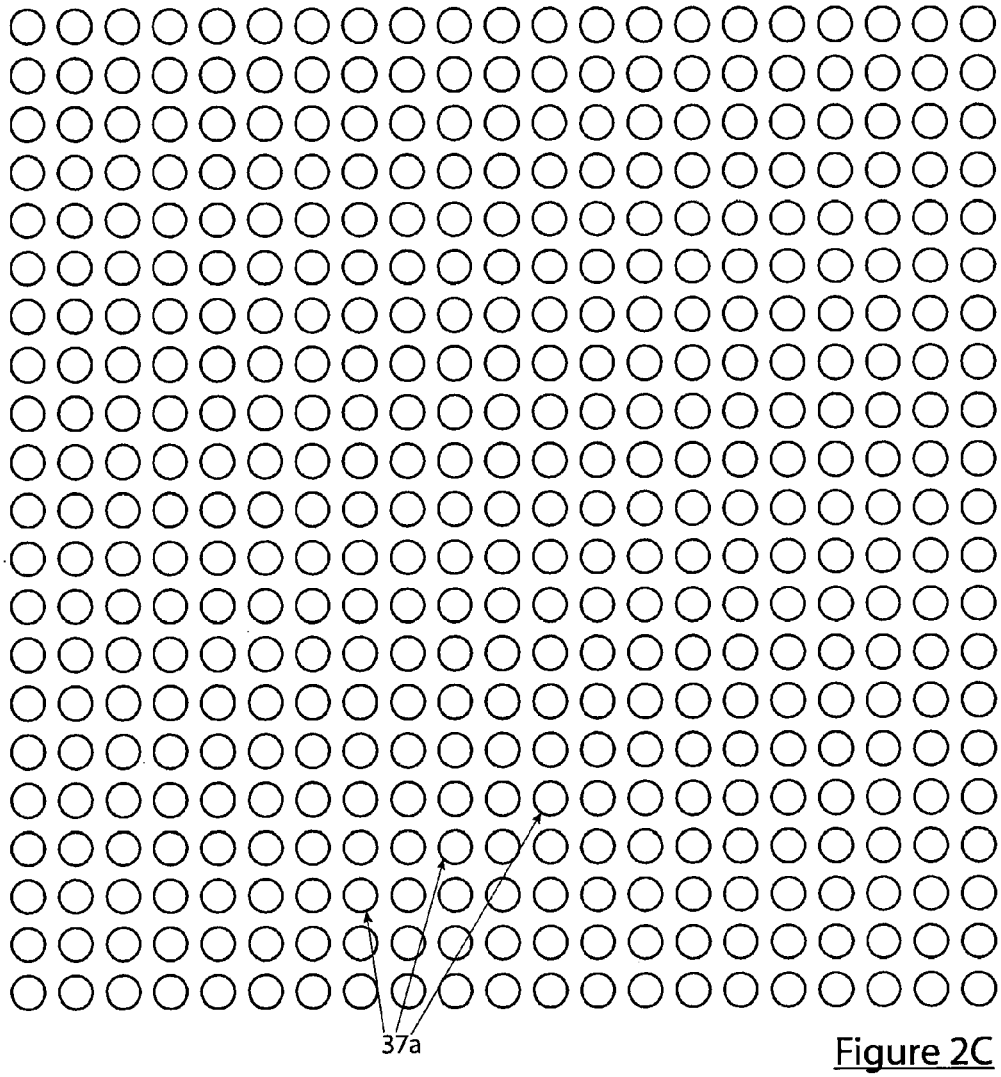
FIG. 2C illustrates an embodiment comprising a ceiling aperture configuration in which the apertures are ranged in a rectangle.

FIG. 2C illustrates an embodiment comprising a ceiling aperture configuration 45 in which apertures 37*a* are ranged in a rectangle. Thus, for example, if visual field objects were dropped simultaneously or sequentially from the apertures 37*a* along and "X" extending from the corners of the rectangular ceiling aperture configuration, a fully three-dimensional manifest image of an "X" extending from the top to the bottom of the visual field could be produced.

Hopper 16 (FIG. 1) may be any shape or size desired. Indeed, any shape or type of container for receiving or dispensing visual field objects that are either present in the hopper or recirculated to it may be used. Typically, the hopper or other container will be fixed by conventional means in an area above a façade that hides the hopper and other components of the falling pattern imagery system. A façade that functions in this way will be represented generally below by ceiling 24. The falling pattern imagery system may also be constructed without a façade or ceiling or with only a partial façade or ceiling.

Ceiling 24 will include apertures 26 corresponding in number, position and size to apertures 22 in bottom panel 18. If, however, less than all of the apertures in bottom panel 18 are employed, the ceiling may include apertures corresponding only to those bottom panel apertures that are employed. Also, while it is preferred that apertures 26 be of the same size as apertures 22, apertures 26 may be larger than apertures 22.

Hopper 16 and ceiling 24 are oriented with respect to each other so that their respective apertures 22 and 26 are in alignment. Preferably, the hopper will extend across the entire portion of the ceiling that contains apertures 26 so that all of the ceiling apertures may pass visual field objects received from the hopper, as will become clear from the discussion below. Although it is preferred that the ceiling below the hopper be generally horizontally disposed as shown, it may be placed at any desired angle greater than 90° from the vertical (e.g., not horizontal and not vertical) up to just short of 90° to the horizontal so that gravity will propel the visual field objects downwardly. Additionally, the ceiling need not be planar as shown, but may be shaped as desired.

Figure 3:
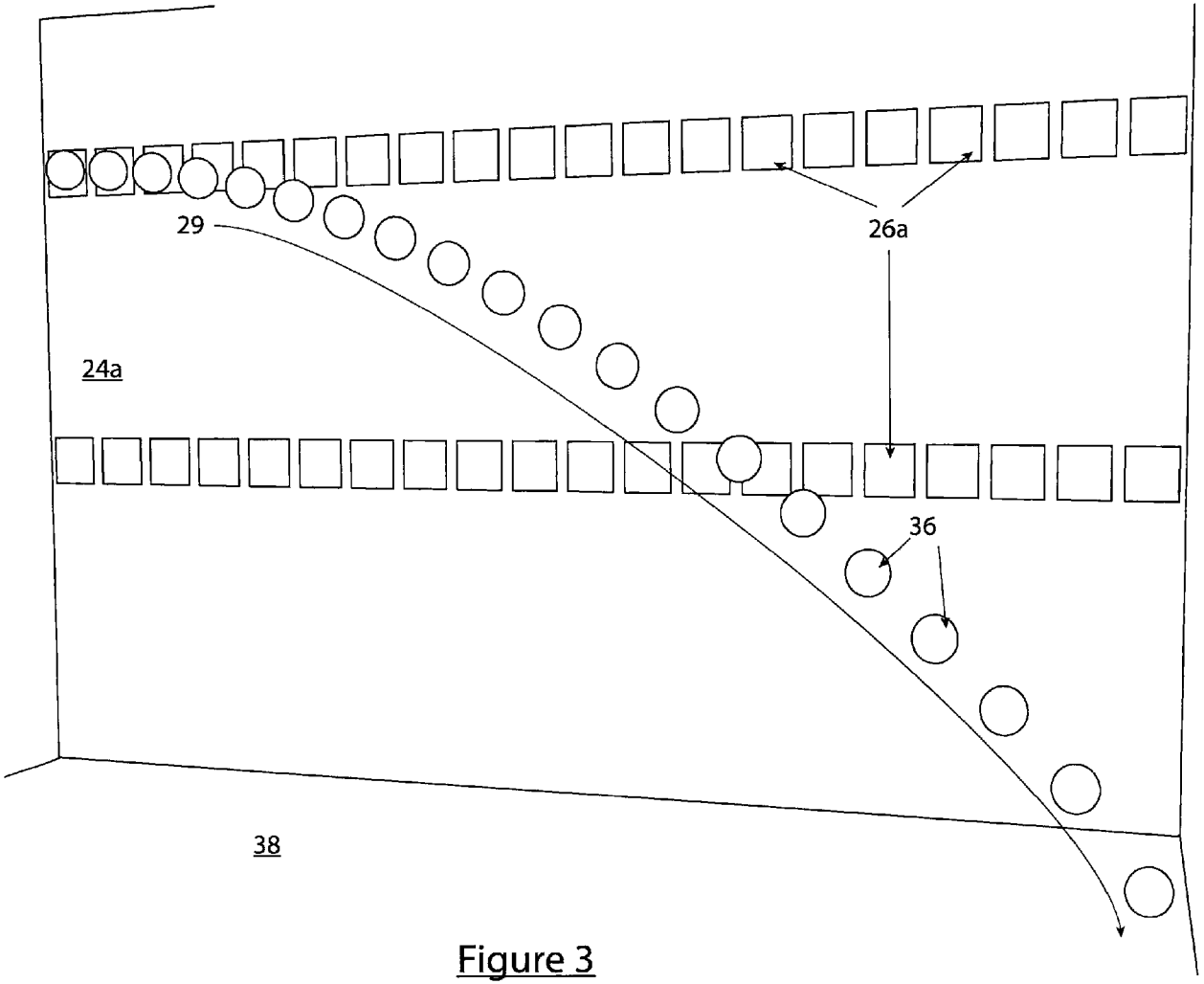
FIG. 3 illustrates a near vertical façade or wall with apertures at the end of hollow ducts from which visual field objects may be released and fall generally vertically to produce a fully three-dimensional manifest image of a cube.

FIG. 3 illustrates a near vertical façade or wall 24*a* with apertures 26*a* at the end of hollow ducts (not shown) leading from a hopper (not shown) containing a plurality of visual field objects 36. The visual field objects are released from the apertures in the wall and fall in an arc as shown.

Hopper 16 is intended to hold a plurality of visual field objects that are to be used in producing abstract and manifest images within visual field 40, as will be described below. Visual field objects that pass through the visual field are recirculated to the hopper to maintain a continuous supply of visual field objects in the hopper. Preferably, a mixing device (represented diagrammatically as feature 34 in FIG. 1) will be provided within or connected to the hopper for keeping the visual field objects circulating within the hopper. Such movement helps maintain an even distribution of the objects across the top surface 19 of bottom panel 18 of the hopper to continuously provide the visual field objects the opportunity to engage apertures 22 without clogging. However, it must be understood that embodiments of the invention are not intended to be limited to any particular method of providing the field objects the opportunity to engage or exit at the apertures.

Mixer 34 may be any appropriate mixing device such as a conventional stirring-type device or vibratory-type device capable of keeping the visual field objects circulating across apertures 22. An example of a stirring-type mixer that may be used is a device that has a motor 35 turning a central shaft 37 with one or more paddles 39 attached that push the spheres about as the shaft rotates. If the mixer is a vibratory mixer, it may be arranged to vibrate the hopper left/right, up/down, or randomly at a sufficient amplitude to keep the visual field objects circulating.

A plurality of hollow ducts 28 that are open at their respective top ends 30 and bottom ends 32 extend between apertures 22 in the bottom panel of the hopper and apertures 26 in the ceiling to deliver the visual field objects from the hopper to the apertures in the ceiling. The ducts preferably are long enough to allow two or more visual field objects to be collected in each duct. The longer the ducts, the more visual field objects can be collected in each duct, resulting in a greater flow rate of visual field objects from the bottom ends 32 of the ducts when the visual field objects are synchronously released.

Figure 18:
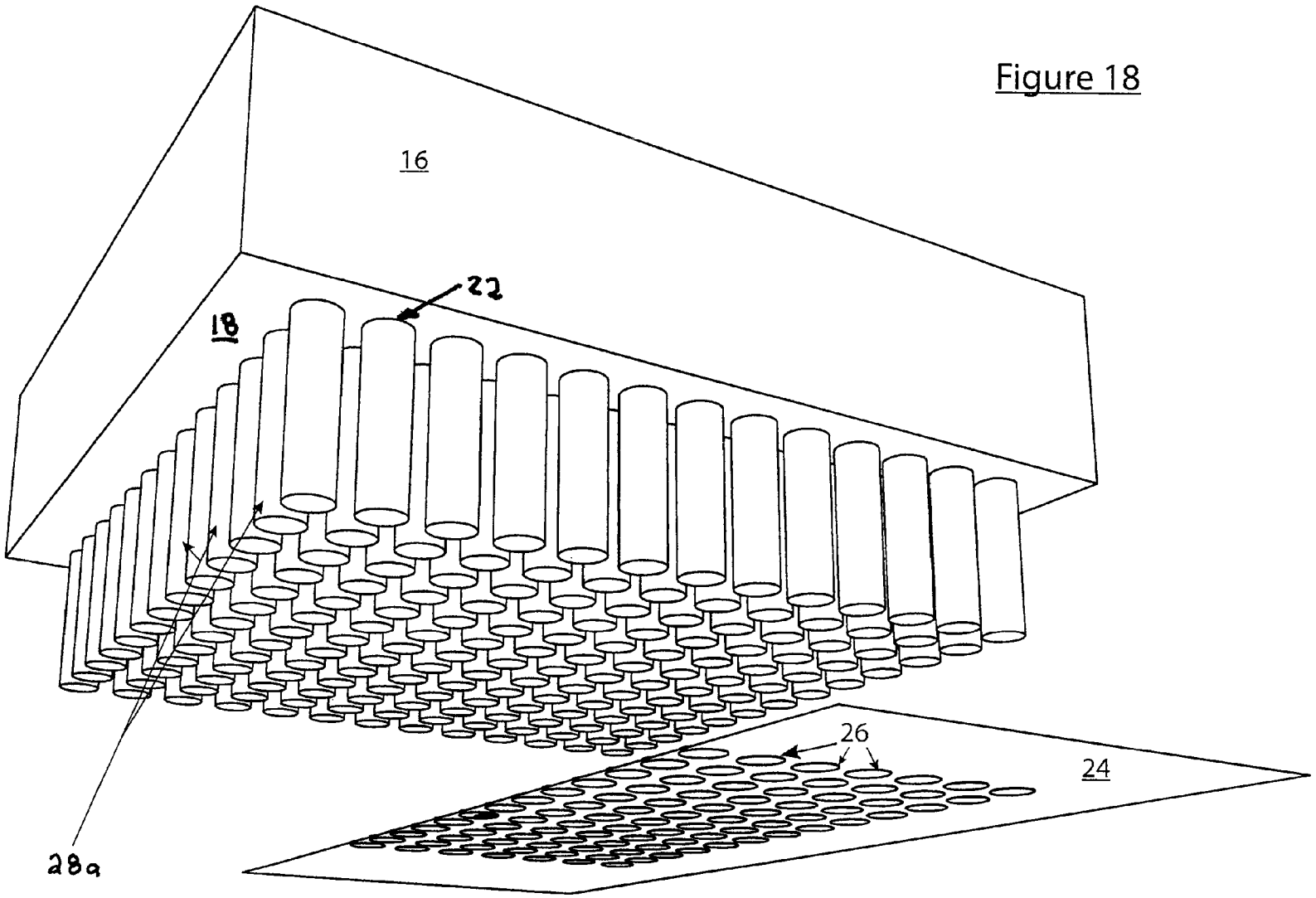
FIG. 18 shows an embodiment in which ducts do not extend the entire distance between the container apertures and the façade apertures.

In an alternate embodiment, panel 18 and ceiling 24 are also oriented horizontally, and holes 22 and 26 may be aligned with only a partial duct 28*a* running between them (FIG. 18). Such a structural arrangement will permit visual field objects to fall vertically under the force of gravity between bottom panel 18 of the hopper and the ceiling while being confined in the duct during only part of their trajectory. Finally, some or all of ducts 28 optionally may also extend to below the bottom surface of the ceiling so that the visual field objects begin their fall from the duct ends at a location in the visual field space below the ceiling.

Ducts 28 may be any shape desired, although cylindrical ducts (as shown) are preferred. In all cases, the ducts must be large enough to permit free movement of the visual field objects through them. It is preferred that the ducts be only large enough to minimize friction where the field objects pass the duct inner surfaces to maximize the repeatability and accuracy of the movement of the visual field objects after they are released from the ducts in successive drop cycles. Ducts 28 may have a square, rectangular, triangular, or other polygonal cross-section. Apertures 22 and 26 should not interfere with passage of visual field objects through the ducts and preferably will have a size and shape corresponding to the cross-sectional shape of the ducts.

Ducts 28 each include a gating device 42 to control the intervals at which the visual field objects fall through each of the ducts to produce synchronous imagery. The higher the gating device is located on the duct, the straighter will be the trajectory of the visual field object as it exits the bottom of the duct. For example, for a 6.0 inch sphere, in a 6.1 inch diameter tubular duct, 6 inches above the ceiling height is sufficient to give a very repeatable and straight trajectory. The gating devices of each duct are controlled as explained below in such a way that the synchronous release of the plurality of visual field objects produces predetermined, desired abstract and manifest images in visual field 40.

The gating devices may be located outside of the ducts with an operative member passing through a slot, bore or other opening in the duct wall. The gating devices may be solenoids positioned in such a way that when the solenoid current is off, the solenoid plunger extends through a duct bore slot or into the duct and when the appropriate current is provided to activate the solenoid, the solenoid plunger retracts into the solenoid, compressing a return spring. When the current is turned off, the spring decompresses, returning the plunger to its original position extending into the duct. The solenoids preferably will be pull-type and spring loaded although push type spring loaded solenoids can also be used. In fact, any electromechanical valve capable of blocking movement in the ducts can be used, so long as the state switch time is short enough.

Figure 4A:
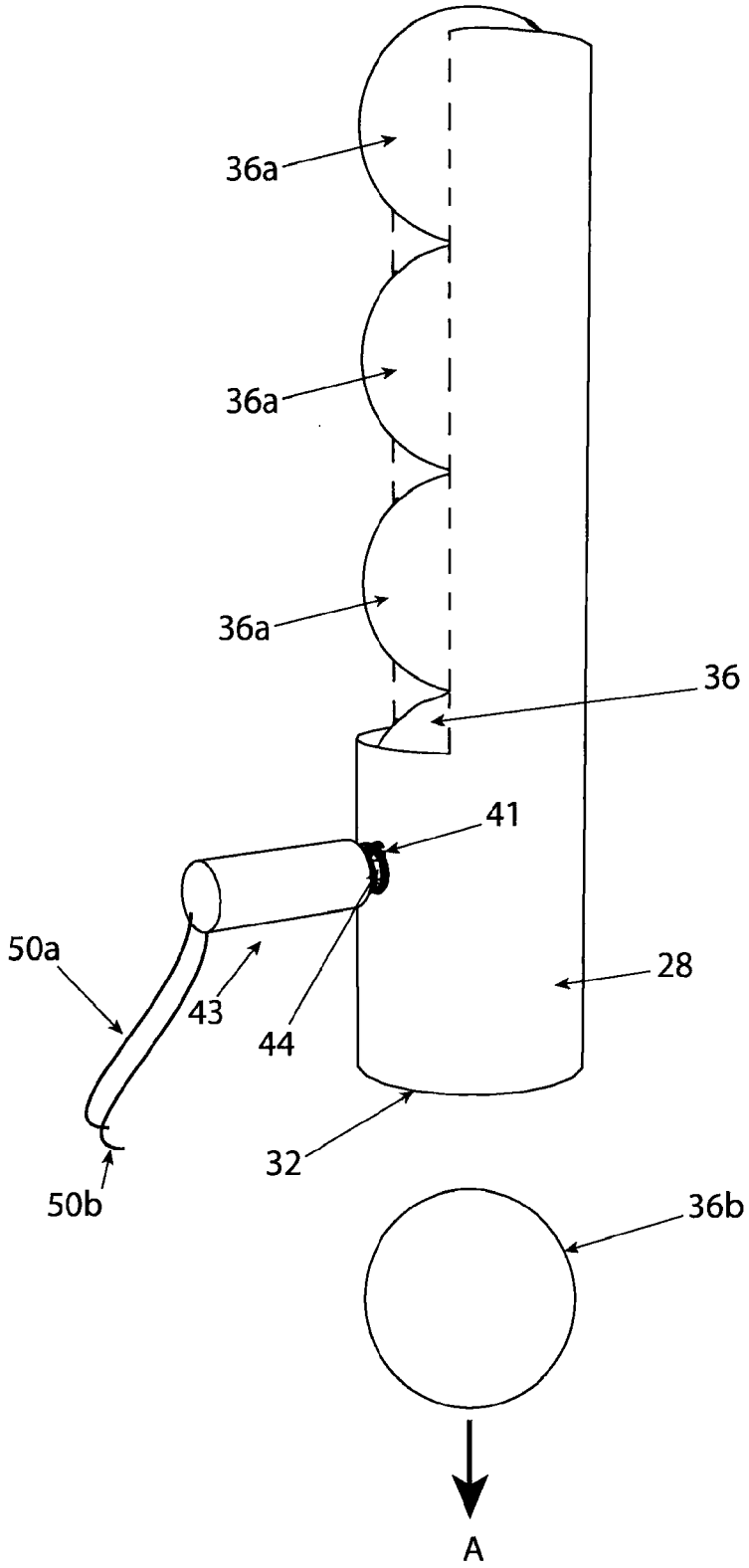
FIGS. 4A and 4B are views respectively of a duct for transporting objects which is partially cut-away to show the objects within the duct and a gating device in the form a solenoid mounted to the duct.

This is illustrated, for example, in FIG. 4A, where a cylindrical duct 28 is shown, partially cut-away to reveal a series of spherical visual field objects 36*a* resting atop one another within the duct. A single visual field object 36*b* falling downwardly in direction "A" appears in FIG. 4A below the bottom edge 32 of the duct. A control bore 41 is located in the wall of the duct. The shape of the control bore will depend on the gating device used to release visual field objects 36*a*. For example, if the gating device is a spring loaded pull type solenoid 43, then the bore may be a just large enough for the solenoid plunger 44 to move freely within the bore. When the solenoid is turned off, the solenoid plunger's spring 46 helps bias the plunger tip through the bore and into the duct. In this "off" configuration, the solenoid plunger prevents any spheres in the duct from being released. When the solenoid is activated, the plunger retracts from the duct, allowing one or multiple spheres to drop from the duct as a part of a drop cycle to produce a synchronous image. The number of spheres dropped depends on the on timing of the movement of the solenoid plunger.

Figure 4B:
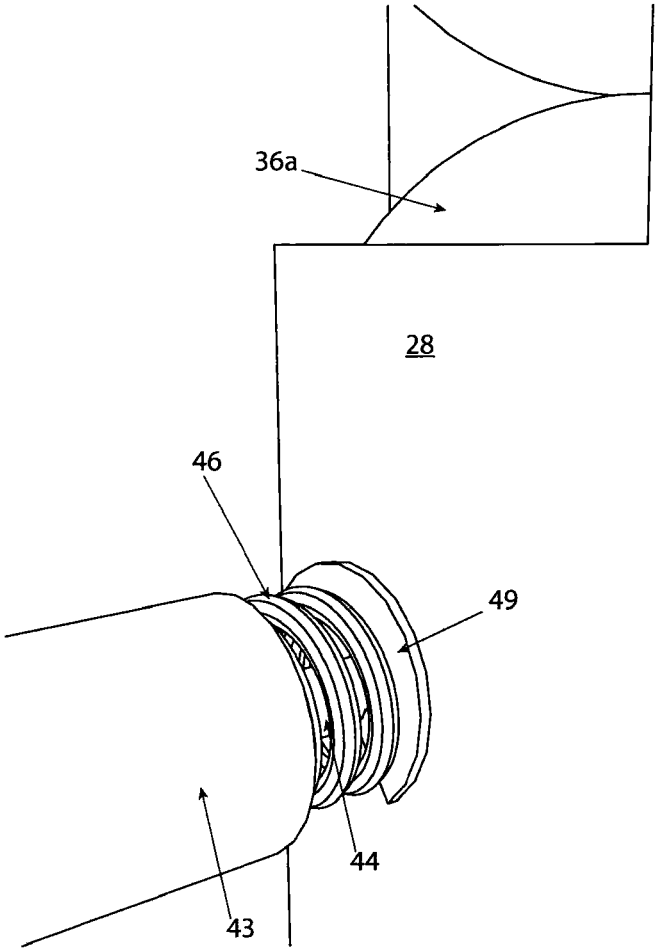

Solenoid 43 is illustrated diagrammatically in FIGS. 4A and 4B with its plunger 44 projecting across the diameter of the duct and a spring 46 which maintains the plunger in an extended (blocking) position until the solenoid is activated. When the solenoid is activated the plunger is withdrawn into the body 48 of the solenoid and the spring is compressed. As shown in FIG. 4B, a "C" clamp 49 is fitted to solenoid spring 46 where it abuts the outer surface of duct 28. The distal tip of the solenoid plunger may be conical to help avoid undesirable interference with the visual field objects. While the solenoids (and plunger or other gating device) may be located at any desired position along the longitudinal axis of the ducts, it is currently generally preferred that it be located near the bottom ends 32 of the ducts. However, if it is desired to accelerate the visual field objects before they emerge from the ducts, the solenoids (and hence release point) may be located higher up on the duct, so long as there is sufficient room for at least one visual field object above the solenoid plunger. Indeed, different visual field objects may be dropped at different velocities by varying the release points in different ducts.

Solenoid 42 includes wires 50A and 50B which run from an electromagnet within the solenoid (not shown) to a solenoid power supply so that application of current to wires 50A and 50B to activate the solenoid will cause the plunger to be withdrawn from the duct, as described above. Thus, visual field objects 36*a* within hopper 16 which are moved about by mixer 34 so that they continuously fall through apertures 22 into ducts 28, will be stored in the ducts and released periodically by powering solenoid 42 to withdraw the solenoid plunger and release one or more visual field objects before the plunger returns to its extended position. The more powerful the solenoid, the more powerful spring 48 can be, and the more powerful the solenoid/spring combination, the faster the on/off switching of the solenoid can be. Precise and rapid on/off switching and movement of the solenoid will produce optimal novel imagery in embodiments of the invention.

Figure 5:
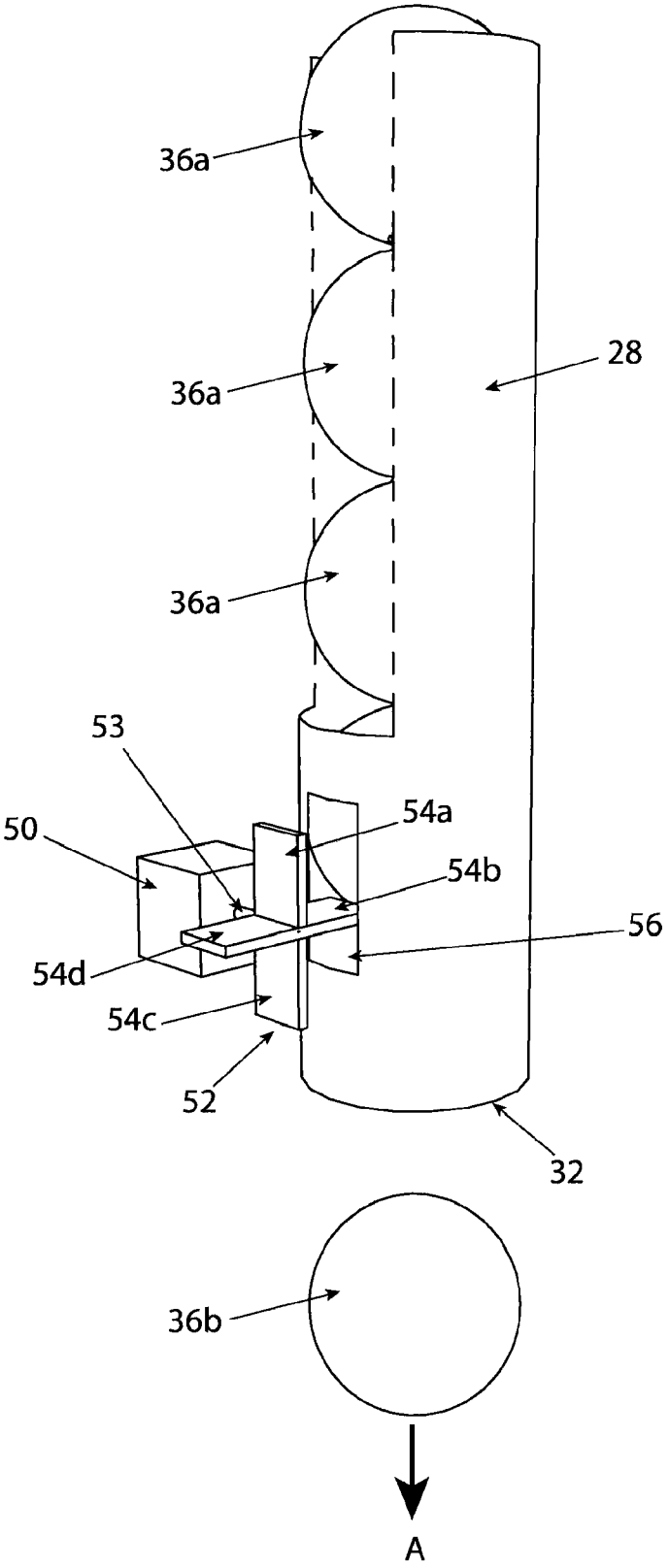
FIG. 5 is a view of another gating device mounted to a duct.

FIG. 5 shows an alternative embodiment of a gating device. In this figure, the gating device comprises a diagrammatically illustrated controllable motor 50 with a paddle wheel 52 mounted to its shaft 53. The paddle wheel has a series of vanes 54*a*-54*d* which extend through a slot-shaped opening 56 in the wall of duct 28. When the paddle wheel is at rest with one of its paddles, e.g., vane 54*a*, projecting generally across the longitudinal axis of the duct, this vane will prevent release of the bottom most visual field object 36*a*. When the controllable motor is powered to rotate the paddles downwardly 90°, vane 54B will release/move the bottom-most visual field object 36*c* while vane 54*c* is moved into place below the next visual field object 36*d*. Thus, the bottom-most visual field object will be released from the duct and movement of the next visual field object through the duct blocked by the next vane.

Figure 16A:
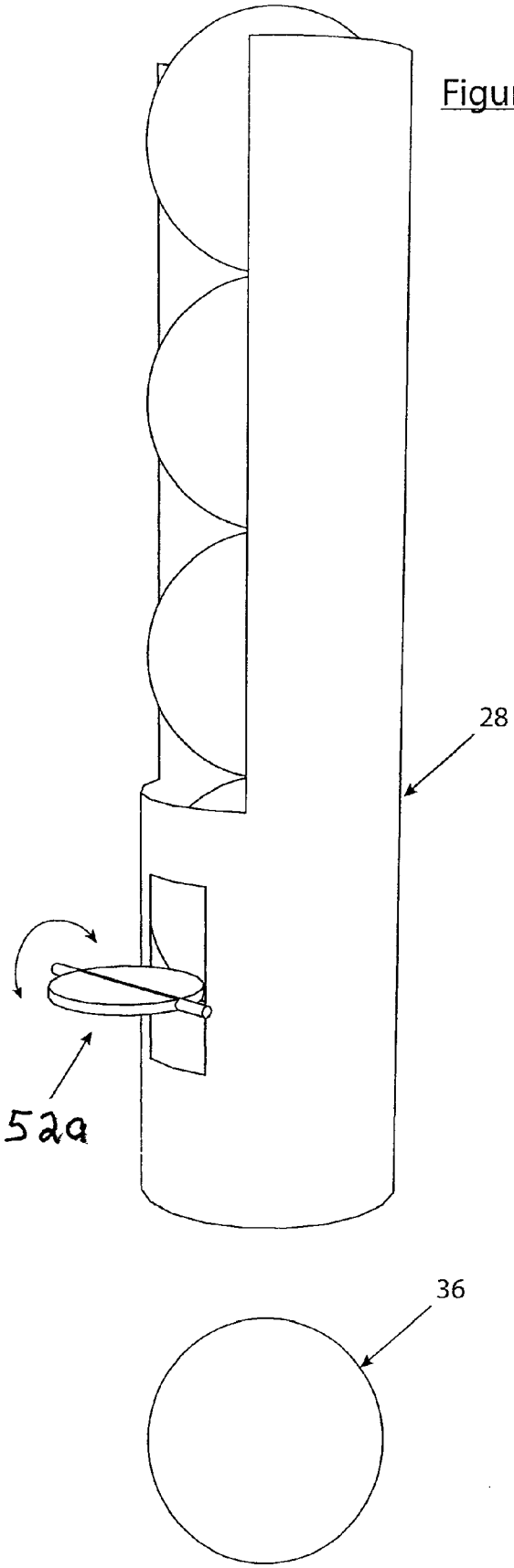
FIG. 16*a* illustrates a butterfly valve gating system that may be used in embodiments.
Figure 16B:
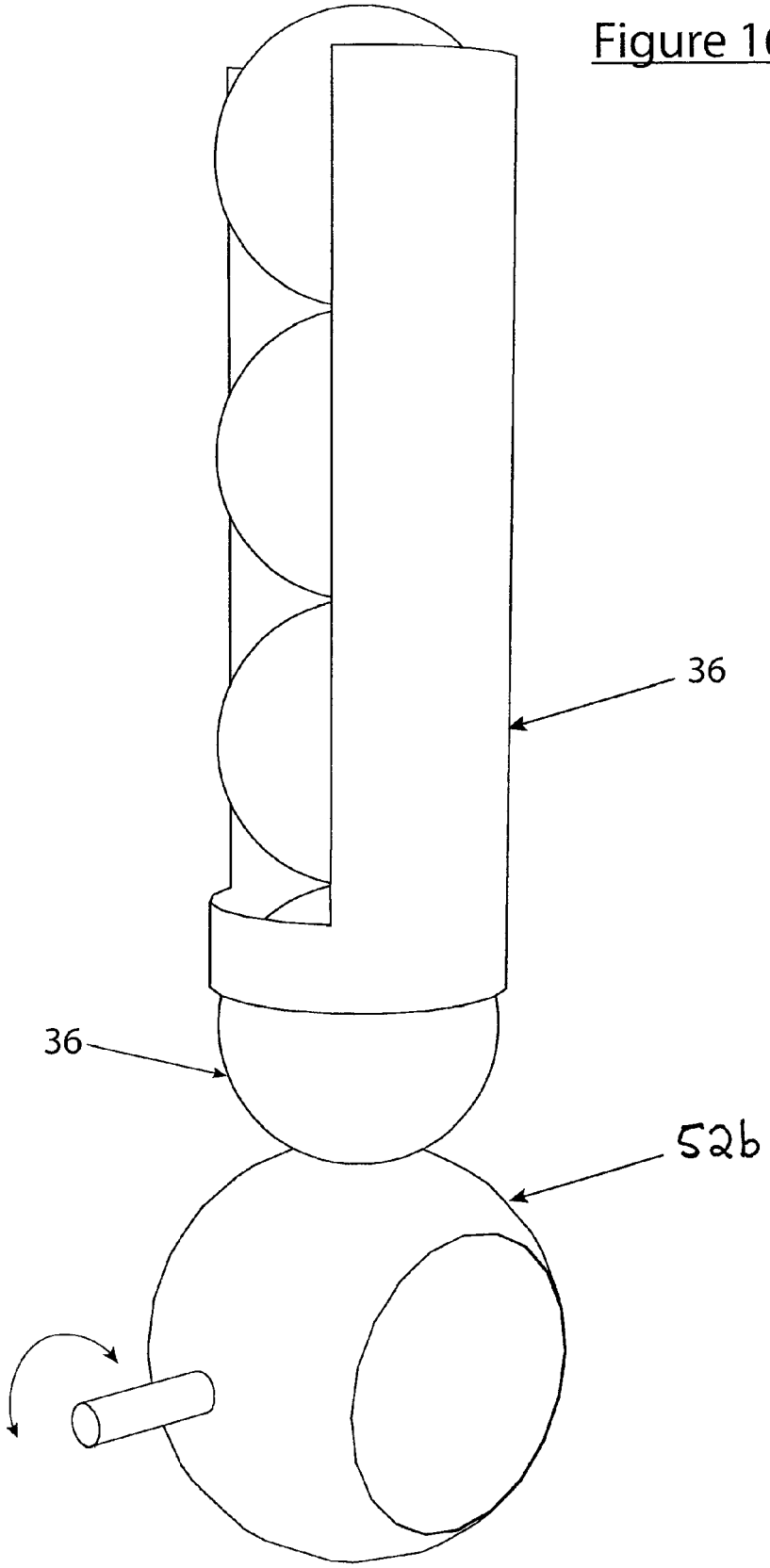
FIGS. 16*b* and 16*c* illustrate a partial ball valve gating device in open and closed positions that may be used in embodiments.
Figure 16C:
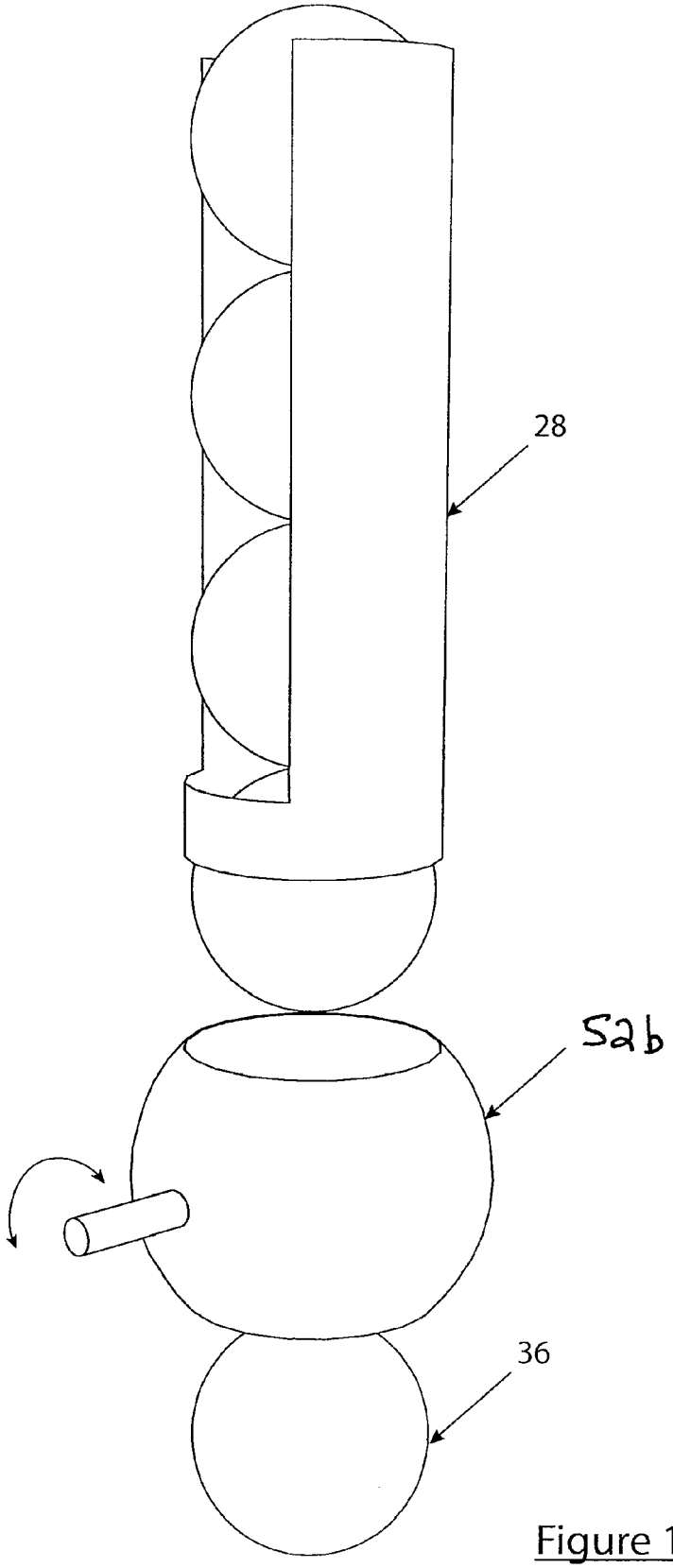

Other types of controllable release valves that can be used as gating devices, include butterfly valves 52*a* (FIG. 16*a*), partial ball valves 52*b* (FIG. 16*b*/16*c*), and diaphragm valves.

In alternative embodiments, a set of secondary gating devices may be included. Such duplication of the gating devices may be used if the weight of the visual field objects is an issue or if the absolute precision of the dropping visual field objects is important as in instances where lighting effects as discussed below are to be maximized, etc.

Figure 6:
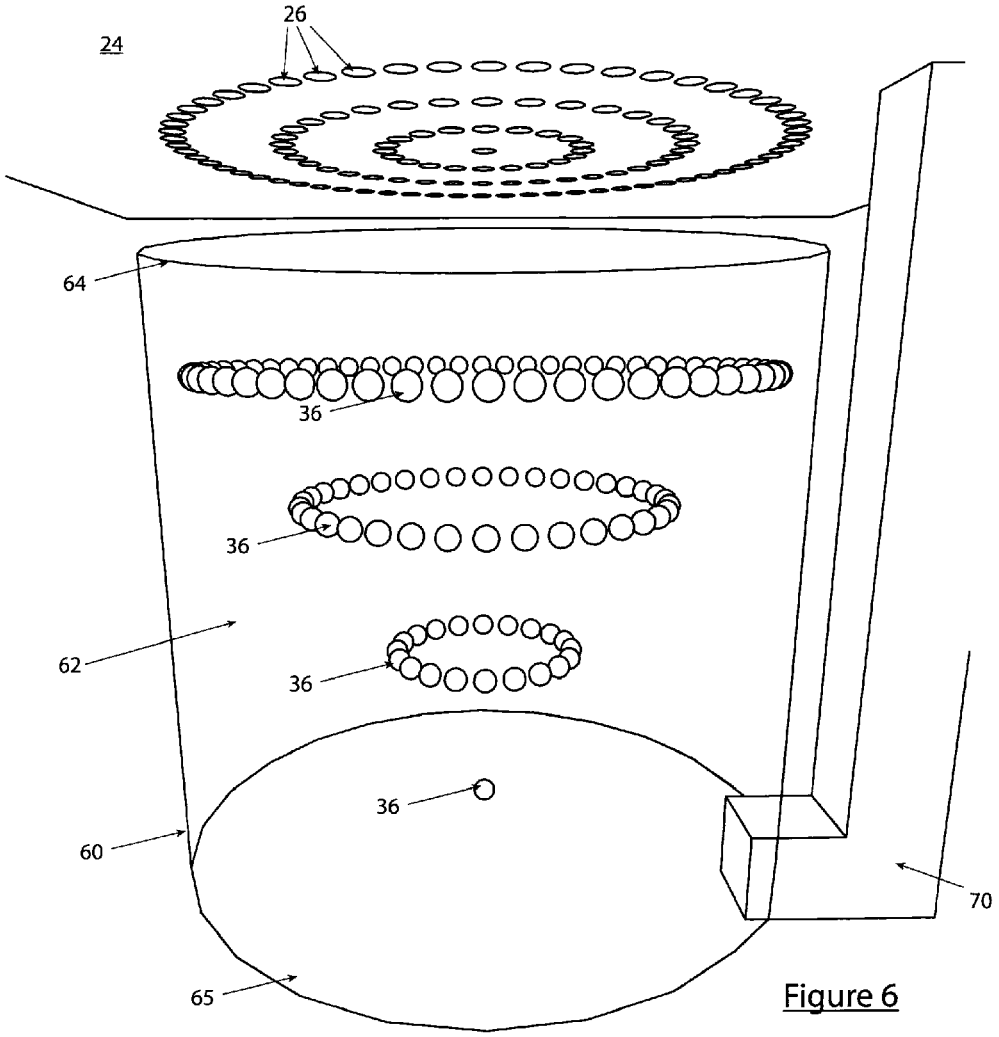
FIG. 6 is a view showing a receptacle which will be located below the visual field of the apparatus containing a fluid such as water or an appropriate oil to reduce bounce-back by the visual field objects and also reduce noise as they are received in the receptacle.

Visual field objects 36 preferably will be received in a receptacle 60 of any desired shape. For example, the receptacle may be a cylindrical container as shown in FIG. 6 which is located below or within the visual field containing a fluid such as water or an appropriate oil 62 which will reduce bounce-back by the visual field objects, slow the rate of descent, and also reduce noise as they are received in the receptacle. If a clear-walled, fluid-filled receptacle 60 is used with an open receptacle top 64, the visual field objects may be observed floating downward in the receptacle. In most embodiments, the visual field objects will be collected below the visual field and returned to the hopper through a recirculating unit 70. For example, the bottom 65 of receptacle 60 may be tilted toward one edge so that the visual field objects roll to that edge where they are withdrawn from the receptacle by the recirculating unit which moves the visual field objects back into hopper 16.

Figure 17A:
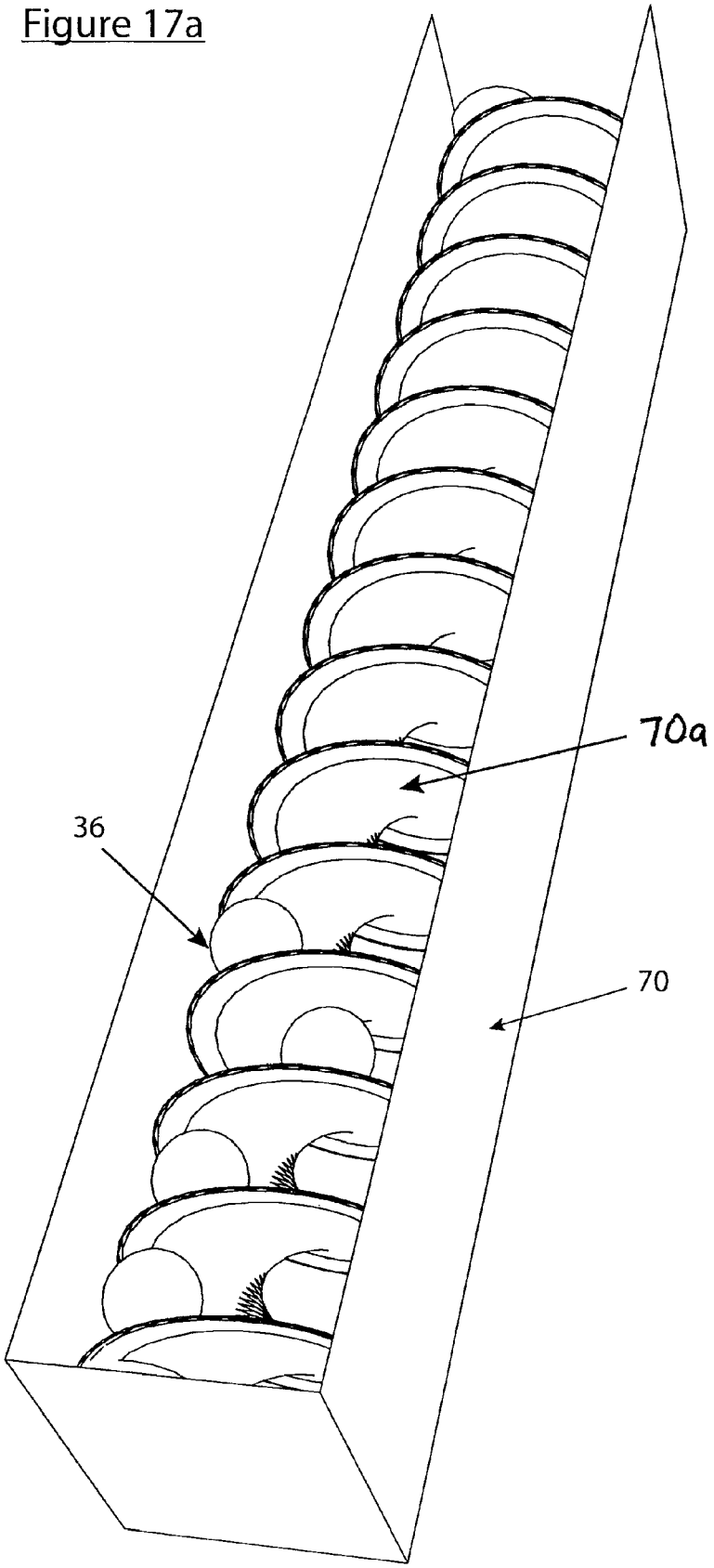
FIG. 17*a* illustrates a screw conveyor recirculating unit that can be used in embodiments.
Figure 17B:
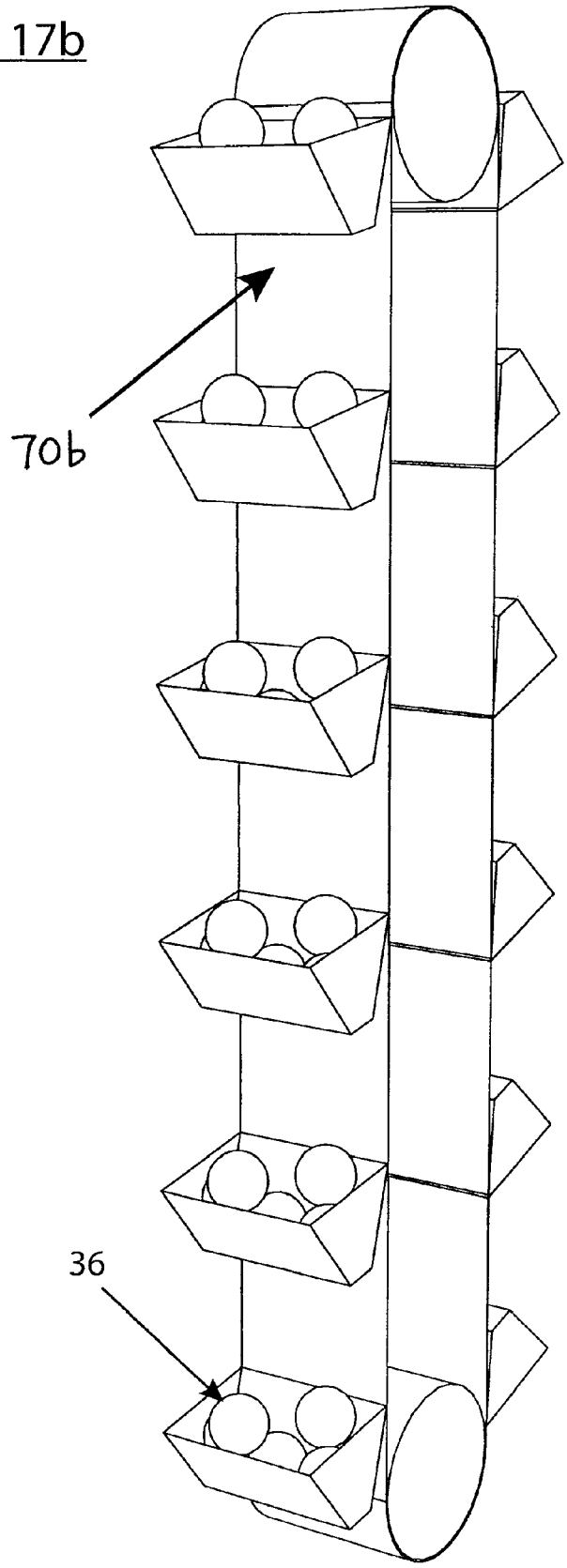
FIG. 17*b* illustrates a bucket conveyor recirculating unit that can be used in embodiments.
Figure 17C:
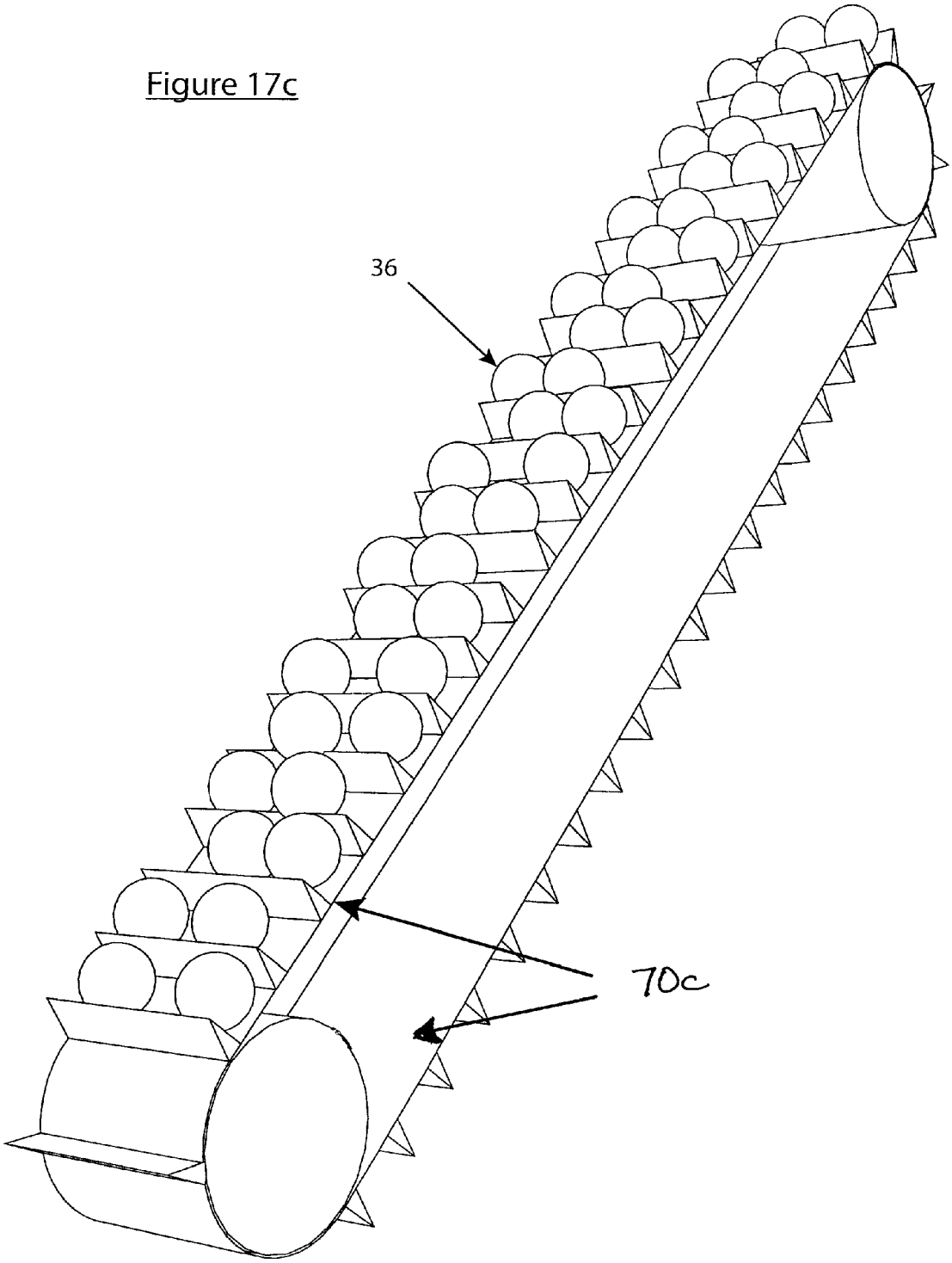
FIG. 17*c* illustrates a belt conveyor recirculating unit that can be used in embodiments.

By whatever means the visual field objects are collected in the receptacle, they may be returned to the hopper by any appropriate recirculating unit which transports the objects upwardly to the hopper. For example, a screw conveyor 70*a* (FIG. 17*a*), a pneumatic conveyor, a chain conveyor, a bucket conveyor 70*b* (FIG. 17*b*), an auger conveyor, or a belt conveyor 70*c* (FIG. 17*c*) may be used.

In an elevator bucket-type recirculating system, a conveyor belt, with appropriately placed buckets on it, travels from the receptacle, picking up visual field objects as it moves through or past available already-dropped objects, continuously carrying and dumping the visual field objects that it picks up into the hopper in the upper section.

Figure 7:
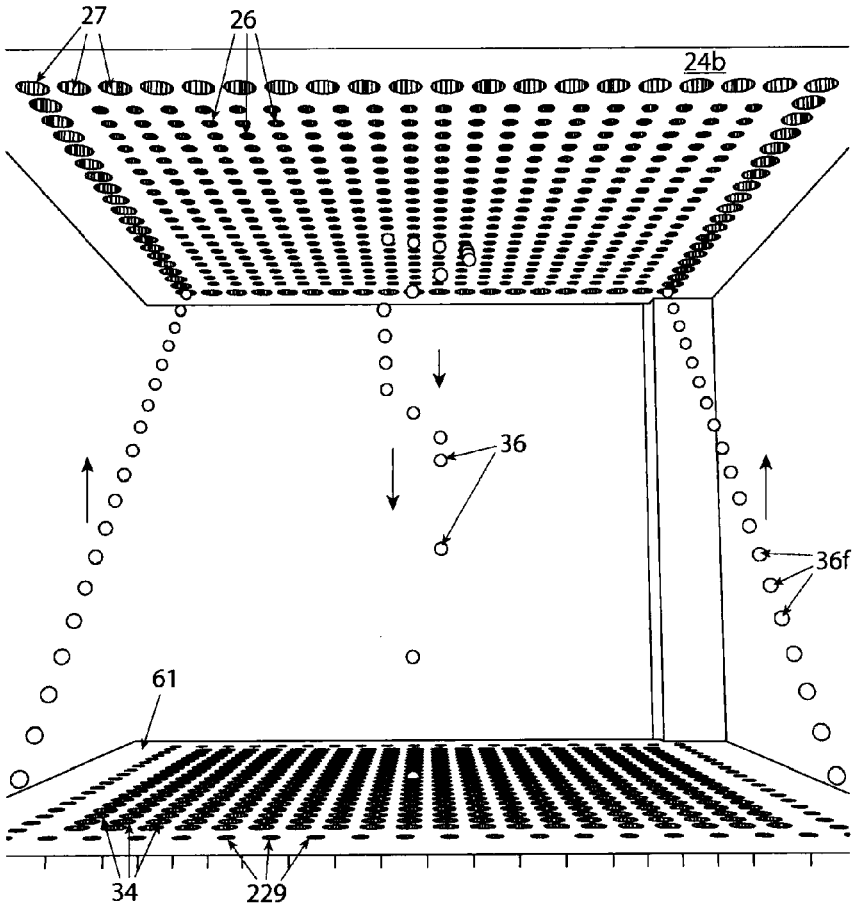
FIG. 7 illustrates a façade or ceiling with a rectangular array of release apertures generally centered in the ceiling, a rectangular array of larger return apertures encircling the rectangular array of release apertures and both falling and returning visual field objects.

One or a series of launch pipes opening may be used to propel objects from a receptacle or other receiving area at the bottom of the visual field, one or several at a time. This is illustrated, for example, in FIG. 7 which constitutes another recirculating system. FIG. 7 includes a façade or ceiling 24*b* with a rectangular array of release apertures 26 generally centered in the ceiling and a rectangular array of larger return apertures 27 encircling the rectangular array of release apertures. A plurality of visual field objects 36 are shown falling downwardly from selected release apertures to form an abstract image in visual field 40.

A receptacle platform 61 is positioned below the visual field. The receptacle platform includes a rectangular array of receptacle apertures 84 corresponding to the rectangular array of release apertures 26. The receptacle platform also includes a rectangular array of launch apertures 22*a* encircling the array of receptacle apertures.

As the apparatus operates, visual field objects which traverse the visual field drop through the receptacle apertures and are collected and launched upwardly from the launch apertures as launched objects 36*f* that reach and pass through the receptacle apertures. The launched visual field objects are then collected in a hopper or other receptacle (not shown) and again dropped when desired through the release apertures.

Figure 8:
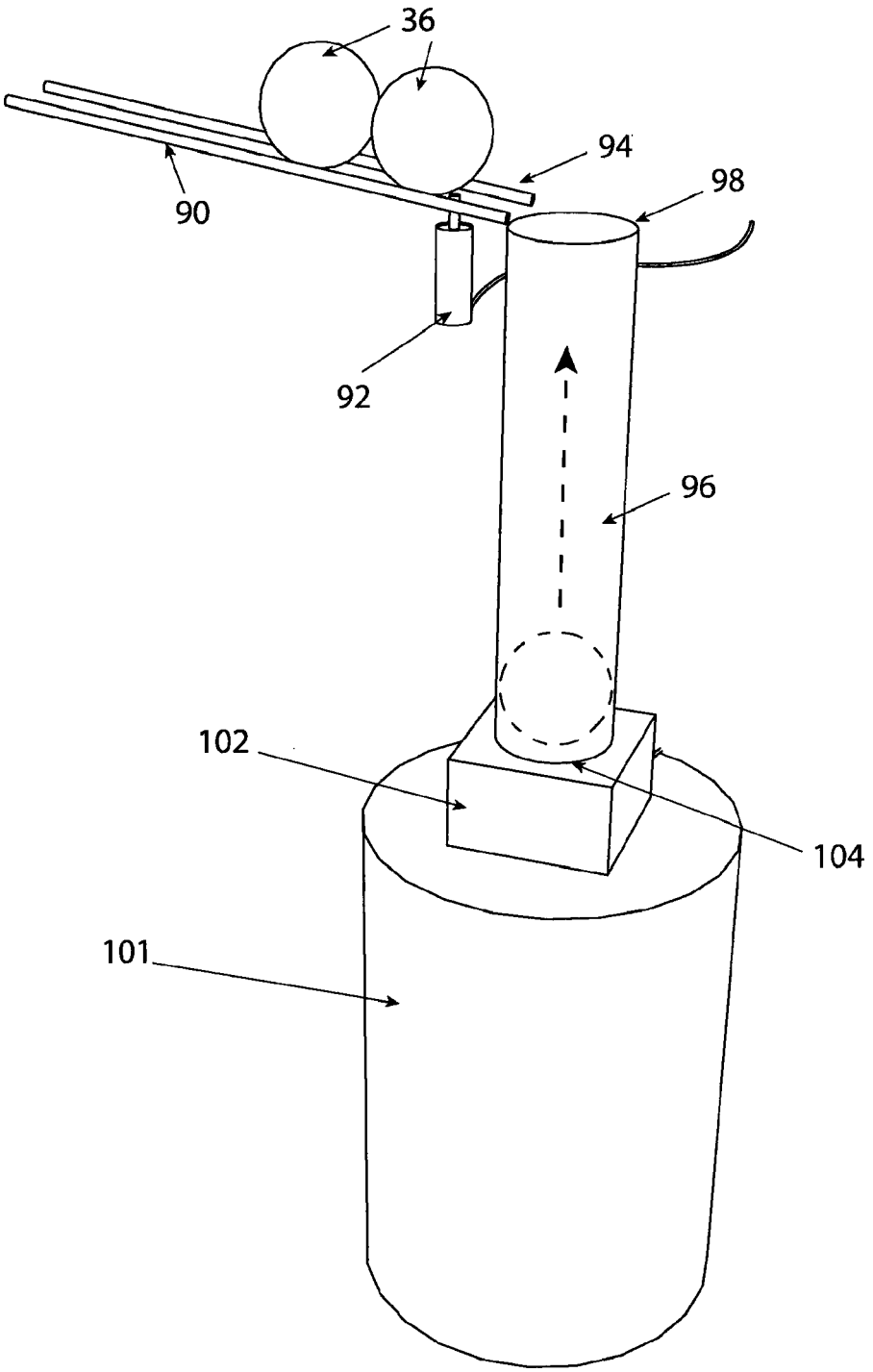
FIG. 8 illustrates an apparatus for launching visual field objects from below a visual field back to a receptacle above the visual field.

One method for launching the visual field objects from the receptacle apertures is illustrated in FIG. 8. This figure includes a gently inclined ramp 90 onto which visual field objects 36 that pass through the receptacle platform apertures are collected. The visual field objects are maintained in place on the ramp by a solenoid (or other appropriate) gating device 92. The proximal end 94 of the ramp is located adjacent the distal end 98 of tube 96. Tubes 96 are dimensioned slightly larger than the diameter of the visual field objects so that the visual field objects may move freely but uniformly through the tubes. A compressed air source such as a compressed air tank 101 is provided along with a compressed air release valve 102 at the proximal end 105 of tube 98. Additionally, tubes 96 need not be vertically disposed, but rather may be angled to produce desired object trajectories. Indeed, the tubes may be mounted to x/y/z controllers to vary trajectories as the apparatus operates.

Thus, when it is appropriate to launch a visual field object from a receptacle aperture, solenoid gating device 92 is triggered to open, permitting one or more visual field objects to roll off of end 98 of the ramp into tube 96 and compressed air release valve 102 is opened at a time predetermined to correspond to the time at which the visual field object will reach the proximal end 104 of the tube. The released compressed air will propel the visual field object upwardly, through the corresponding launch aperture, across the visual field, and into a predetermined receptacle aperture in ceiling 24*b* (FIG. 7). By properly positioning tubes 96 and precisely controlling the pressure and duration of the launch valve open time, the trajectory of the projected visual field objects will be predetermined and known. In this way, the visual field objects can be projected back into the hopper or other receptacle above the ceiling. Furthermore, the pattern of downwardly falling visual field objects and launched, returning visual field objects will add significant interest to the imagery.

Synchronized kinetic imagery system embodiments are driven by a control unit which controls the gating devices 42 to produce a continuous cycle of falling visual field objects. The program may also drive the recirculating system and, if a compressed air launch is used, the software may control the compressed air source in the launch pipes. An off-the-shelf program shelf program/controller, such as Unitronics Unistream (http://www.unitronics.com/plc-hmi/unistream) may be used for this purpose.

Figure 9:
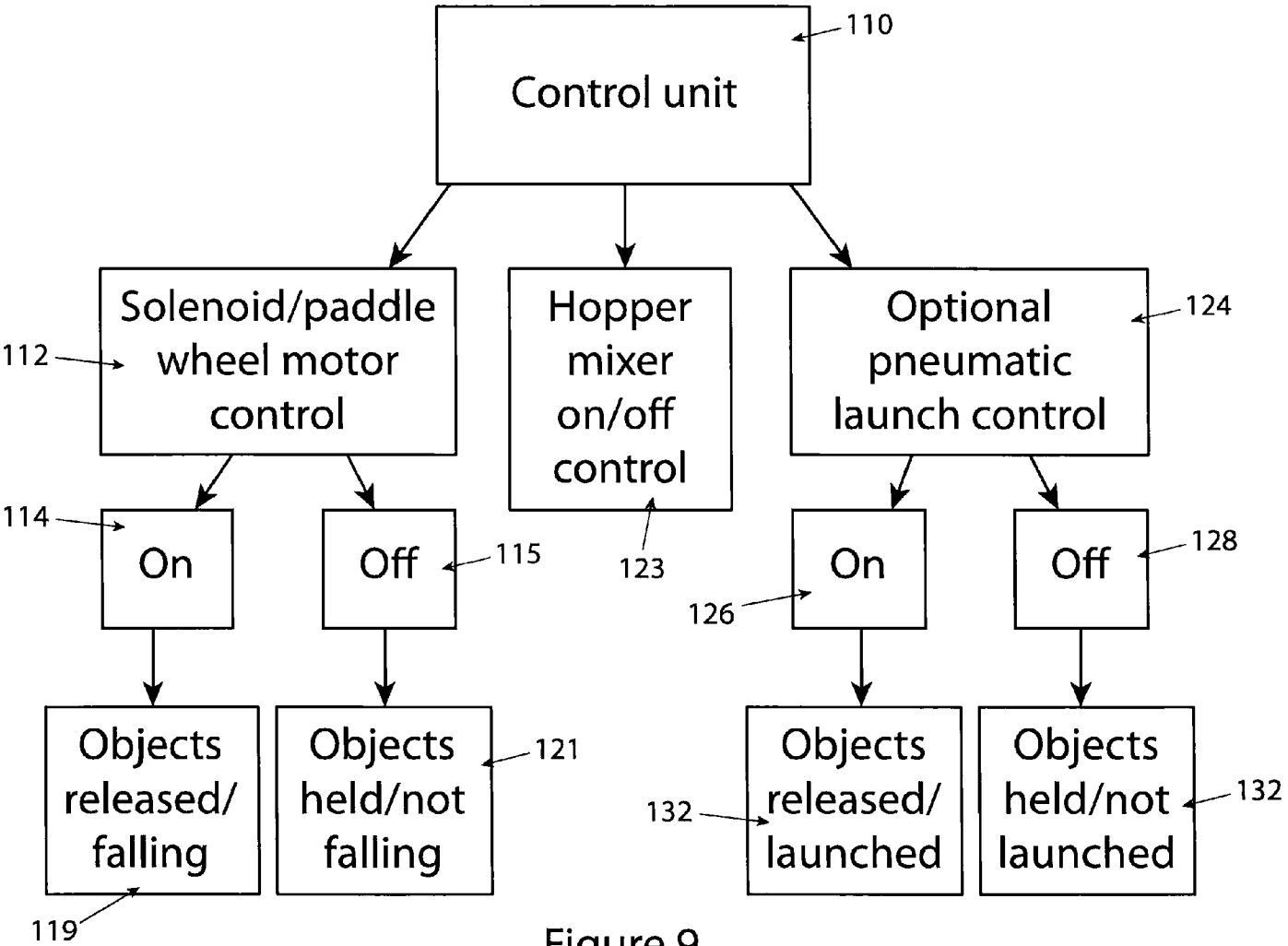
FIG. 9 is a flow diagram illustrating an embodiment of a control unit and apparatus in accordance with embodiments of the invention.

Alternatively, a conventional computer/microprocessor may be programmed using known programming techniques to carry out the process illustrated in FIG. 9. This figure shows a control unit 110 which is wired to a gating device 112 such as solenoid 43 or paddlewheel 52. The computer/microprocessor will control the on/off operation (114, 115) of gating devices associated with each of the ceiling apertures to release and hold (119, 121) the visual field objects when required to produce a desired image.

In order to keep the system supplied with visual field objects, computer/microprocessor 110 will be programmed to turn the hopper mixer on and off (123) as necessary to keep the visual field objects advancing within the apparatus.

Finally, where an optional launch system as described above is used, computer/microprocessor 110 will drive a pneumatic launch control 124, turning it on or off (126, 128) for releasing visual field objects and releasing compressed air at the appropriate times to launch or hold the objects (130, 132).

A cycle of operation of the apparatus is illustrated in the following matrix implemented by a computer program which triggers gating devices 42 in selected ducts 28 in a linear three-dimensional matrix below. In this matrix ducts above apertures 26A-26K of FIG. 1 are listed across the top of the matrix and, release times $t_1$-$t_6$ are listed in the column at the left. Thus, initially the computer or microprocessor will open the gating devices in ducts 26A-26K at time $t_1$. At time $t_2$ the gating devices in ducts above apertures 26B and 26J will be opened, releasing the bottom-most visual field objects in those ducts. At time $t_3$ the same will occur in ducts above apertures 26C and 26I, at time $t_4$ the same will occur in ducts above apertures 26D and 26H, at time $t_5$ the same will occur with the gating devices in ducts above apertures 26E and 26G. At time $t_6$ the gating device in the duct above apertures 26F will be opened releasing the bottom-most visual field object in that duct. This process will continuously repeat as successive visual field objects are released from the ducts.

Figure 10A:
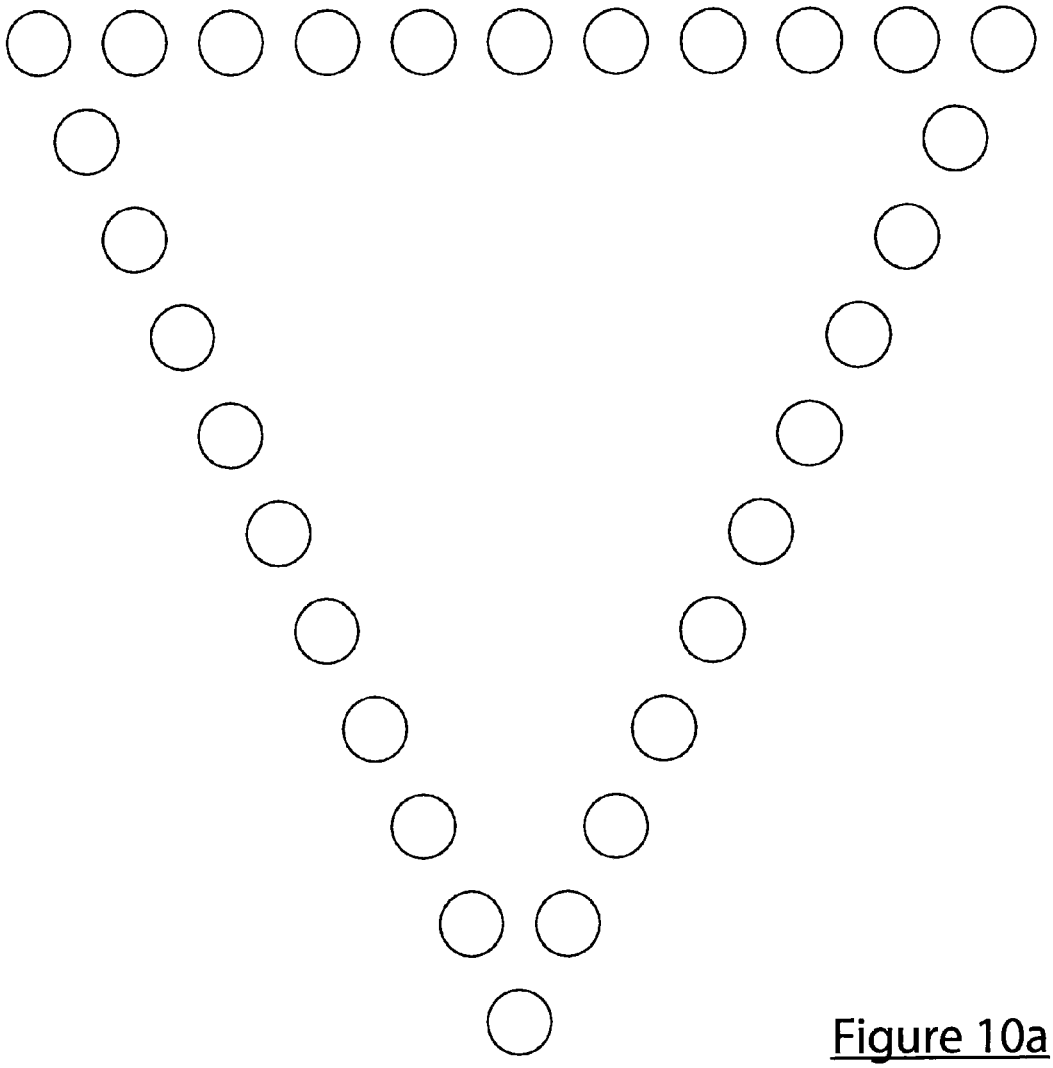
FIG. 10A is a representation of visual field objects producing a triangular shape in accordance with an embodiment and FIGS. 10B and 10C respectively illustrate the sequential display of a company logo followed by the letters of its trademark.

Thus, the visual field objects released at time $t_1$ will be the first to reach the bottom of visual field 40 forming the base of a triangle. As the drop cycle proceeds the visual field objects released at time $t_2$ will arrive just above the first row of visual field objects to begin constructing the sides of a triangle, as depicted in FIG. 10A.

| | 26A | 26B | 26C | 26D | 26E | 26F | 26G | 26H | 26I | 26J | 26K |
|---|---|---|---|---|---|---|---|---|---|---|---|
| $t_1$ | X | X | X | X | X | X | X | X | X | X | X |
| $t_2$ | | X | | | | | | | | X | |
| $t_3$ | | | X | | | | | | X | | |
| $t_4$ | | | | X | | | | X | | | |
| $t_5$ | | | | | X | | X | | | | |
| $t_6$ | | | | | | X | | | | | |

A three-dimensional shape may be generated as described above, by triggering gating devices 42 in selected ducts of a series of rows of ducts.

Figure 10B:
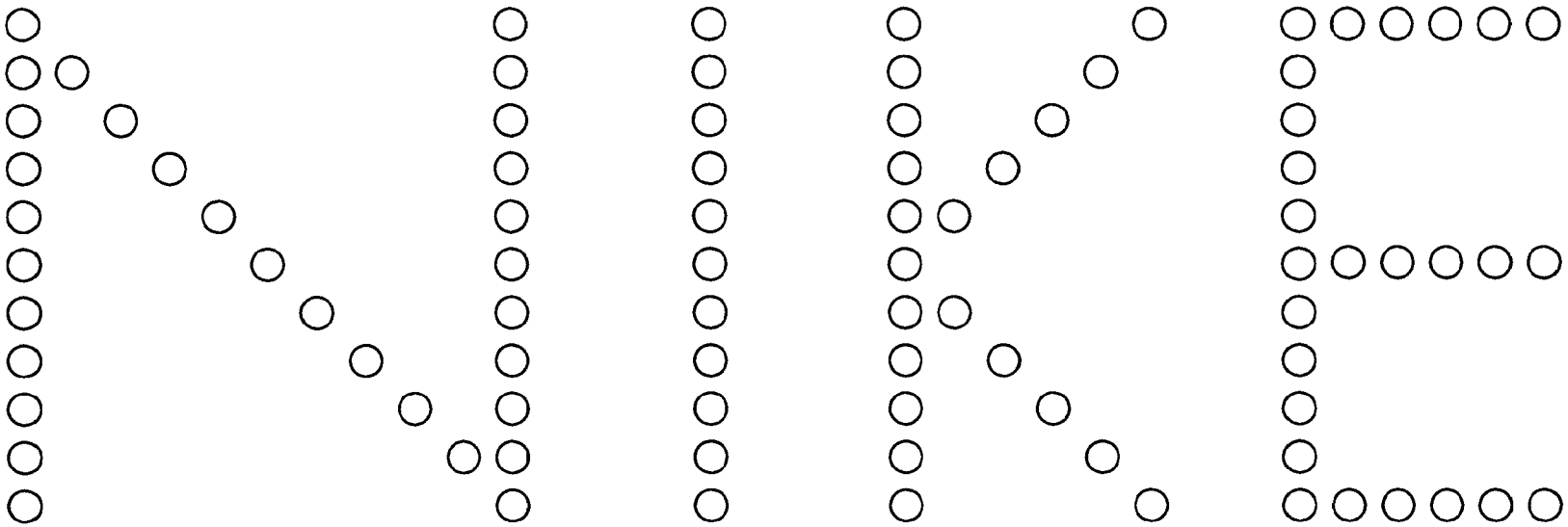
Figure 10C:
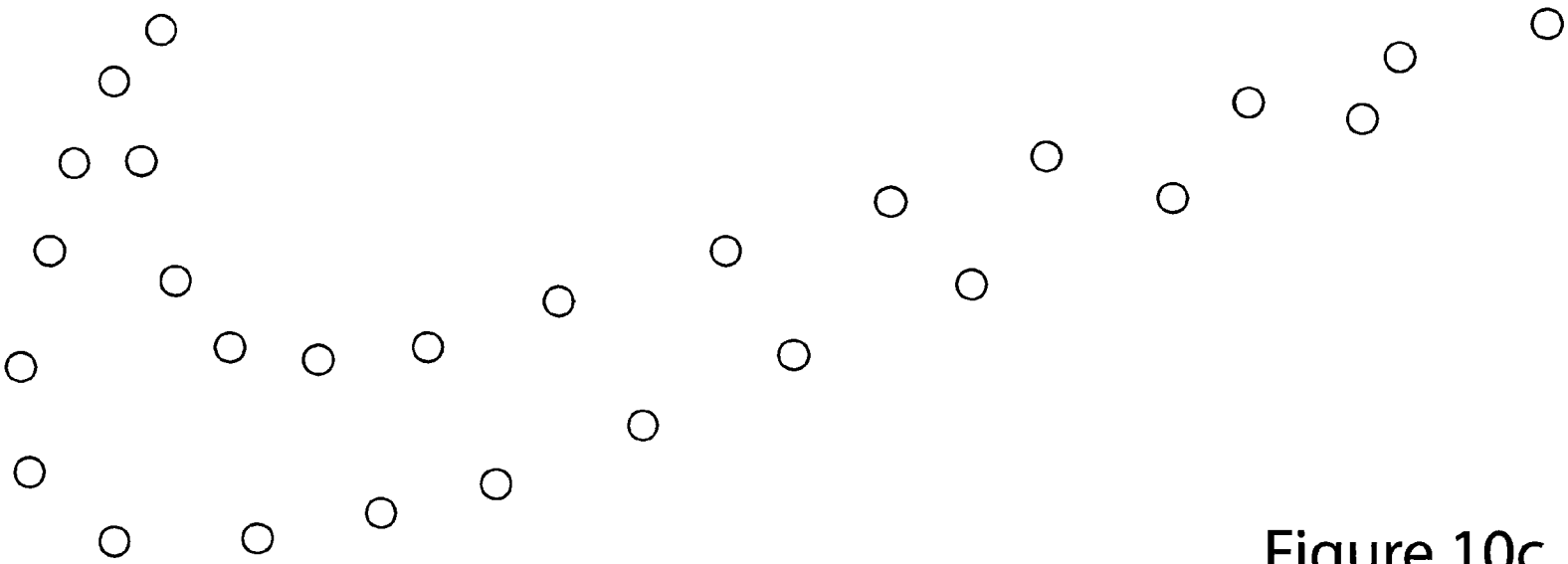

Since each solenoid is independently controlled by the program, a virtually infinite number of image patterns may be generated in this way including abstract images and manifest images. For example, letters of the alphabet may be displayed either sequentially or simultaneously, optionally along with logos, to convey messages, such as advertising messages. This is illustrated in FIGS. 10B and 10C, which illustrate the sequential display of first the well-known Nike logo followed by the "N" of the Nike trademark, which in turn will be followed by the "I", "K", and "E" (not shown) to generate an advertising image for Nike.

While the gating devices are operated in this example to release only one visual field object at a time from each of the designated ducts, multiple objects may be released in this example at one time from the apertures or the time of release of objects in the same row may be staggered to create a triangular image that rocks back and forth as it progresses downwardly within a visual field. It should be noted that visual field objects released one after another in the same on/off drop cycle will remain visually "attached" to each other because they all begin their descent due to gravity together. This stands in contrast to successive visual field objects released by successive on/off cycles where each visual field object starts its descent at a different time, to produce spreading of the visual field objects as they descend.

Figure 14:
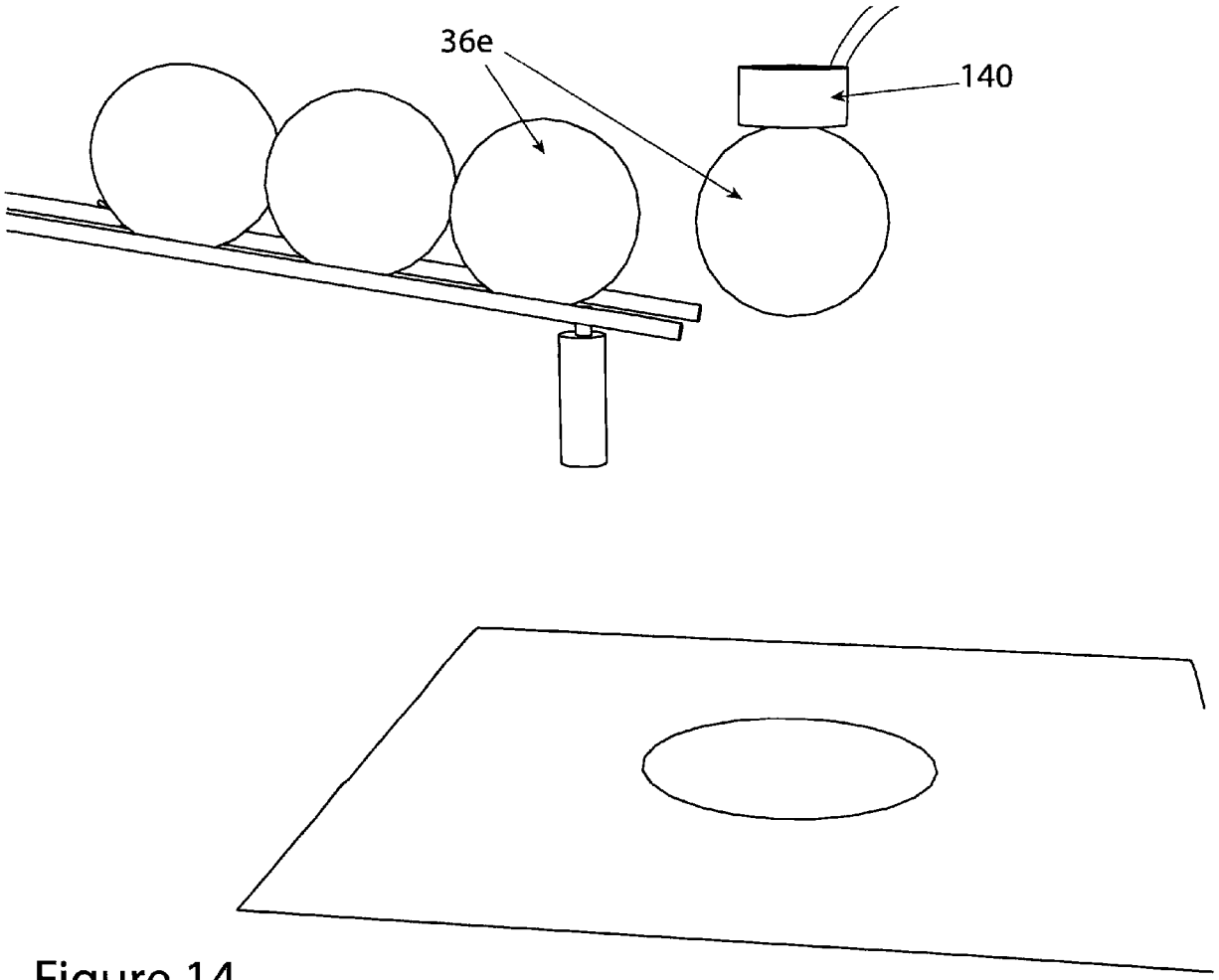
FIG. 14 illustrates an object drop structure in which ferromagnetic visual field objects are retained and released using an electromagnet.
Figure 15:
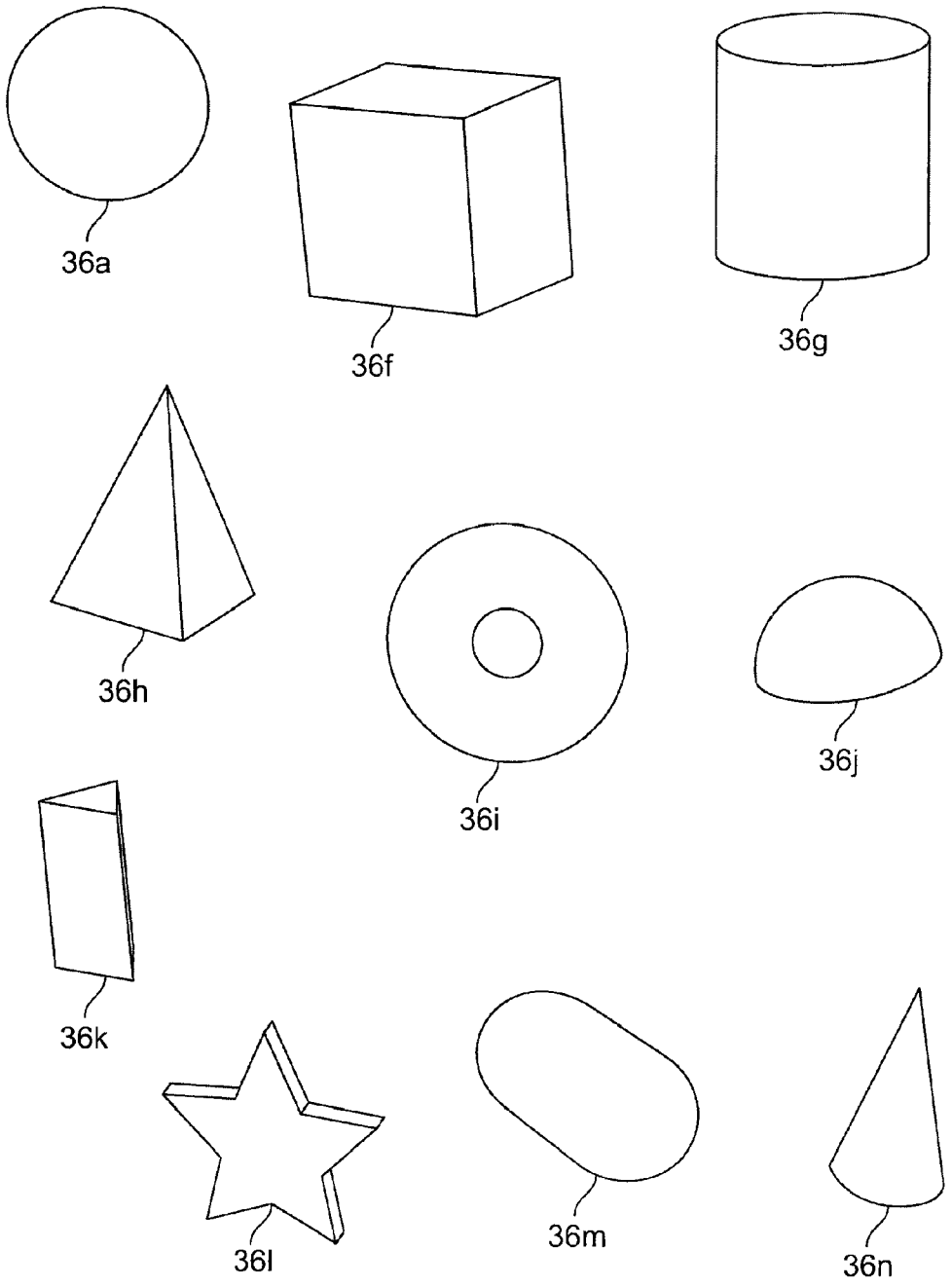
FIG. 15 illustrates a series of visual field objects that may be used in embodiments.

If more precision in the timing of the drops is desired, if the apparatus needs to be silent, or if it is desired to provide an entire apparatus with no moving parts, a structure as in FIG. 14 may be provided. In this structure, visual field objects 36*e* may be made of a ferromagnetic material such as iron, nickel, cobalt, or appropriate rare earth metal alloys and the solenoids (FIGS. 4A, 4B) be replaced with gating devices in the form of electro magnets 140 that are normally in an activated state. When an electromagnet in a particular duct is de-activated, a ferromagnetic visual field object will be released toward the ceiling aperture below, followed by the activation of the electromagnet to trap the next following visual field object.

Figure 11:
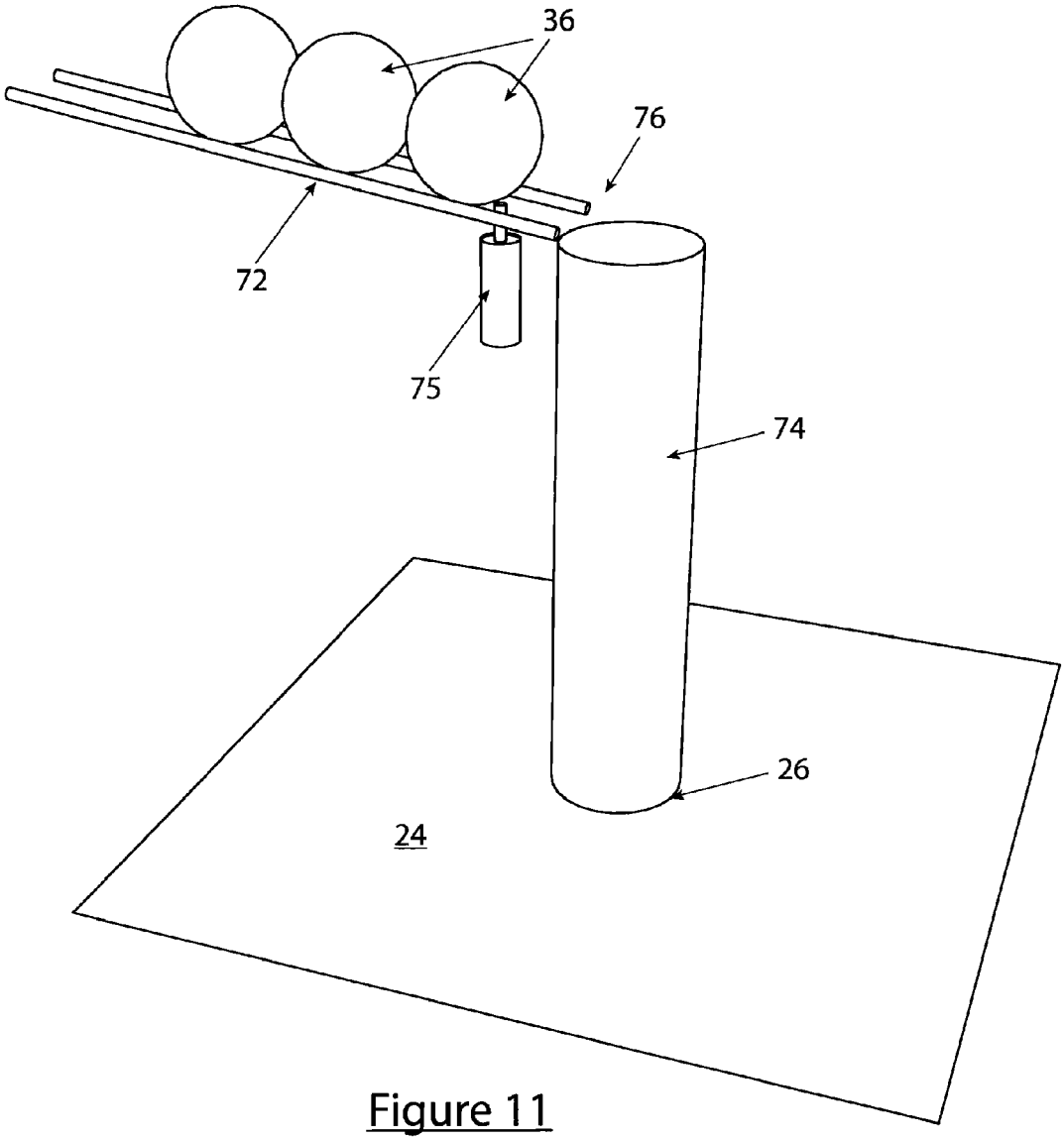
FIG. 11 illustrates an embodiment in which visual field objects 36 are supported by open, gently inclined laterally confining ramps aligned with tubes that open at ceiling apertures 26.

FIG. 11 illustrates yet another embodiment in which ducts are not used. Rather, visual field objects 36 are supported by open, gently inclined laterally confining structures such as ramps 72. The distal ends 76 of these ramps are aligned with tubes or other conduits 74 which open at apertures 26 in ceiling 24. Alternatively, the distal ends 76 of the rails may be aligned with the apertures, eliminating the conduits. A gating device such as a ramp solenoid 75 may be positioned at or near the distal ends 76 of the ramps to release the visual field objects so that they roll down the ramps and pass through the desired apertures when triggered by the system, to produce a desired abstract or manifest image. If it is desired to accelerate the drop of the visual field object, the gating device may be positioned higher up on the ramp so that the visual field object will pick up speed before it passes through the ceiling aperture.

Figure 13:
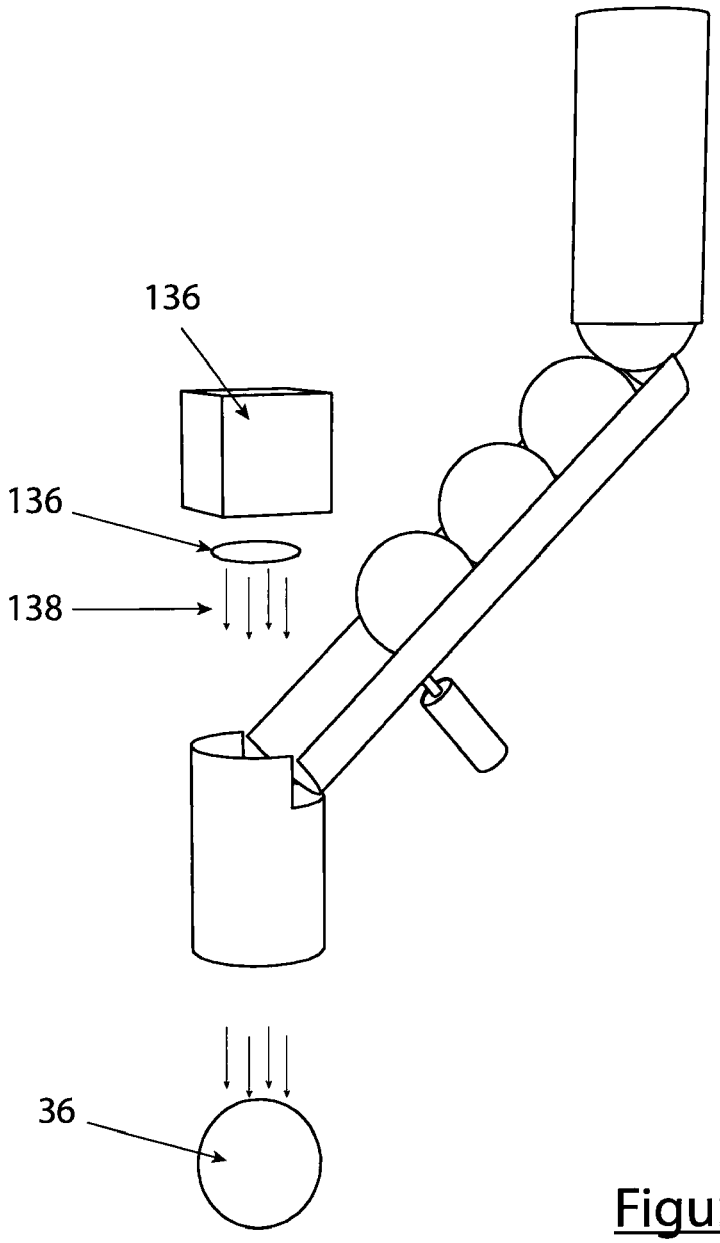
FIG. 13 is a view of an arrangement for illuminating clear or translucent visual field objects which are released from a ramp and pass below a collimated light beam as they fall through a ceiling aperture.

Lighting elements may be integrated into any or all of the ceiling apertures and/or any or all of the ducts. For example, as illustrated in FIG. 13, at an appropriate desired distance and position above selected ceiling apertures 26, a combination of a light source 134 and either a light pipe or a lens 136 with the appropriate focal length may be placed. In this arrangement, the light 138 exiting the light pipe or the lens will be effectively collimated. Thus, if the visual field objects are clear or translucent and are directed under the collimated light as they drop, the collimated light beam will have the effect of illuminating the visual field object and may also give the object the appearance of being a light source itself. When the gating device is momentarily opened to permit a visual field object to fall, the object will remain illuminated with approximately the same intensity (due to the collimated source) as it falls through the visual field. Also, multiple light sources may be used above each aperture, with computer control of the on/off timing, intensity and/or color of each light source to control over the intensity, blinking or color of each object as it drops. Varying colors may be provided, for example, using an array of colored LED lights.

In a similar fashion, this lighting approach may be applied to visual field objects launched from launch pipes where a combination of a light source and either a light pipe or a lens with the appropriate focal length may be placed to direct light into the launch pipes. Finally, the lighting effect may be further enhanced by placing additional reflecting surfaces on or in the visual field objects.

A unique aspect of embodiments of this apparatus is its ability to exploit the principle of superposition in a receptacle partially filled with a fluid. This principle states that the amplitudes of separate waves add (as long as the waves are in their linear region) when they pass through each other. The precision drop control of the visual field objects combined with the visual field objects' unique ability to create very regular circular wavefronts expanding from the pattern object/fluid impact site is key to these embodiments.

Figure 12:
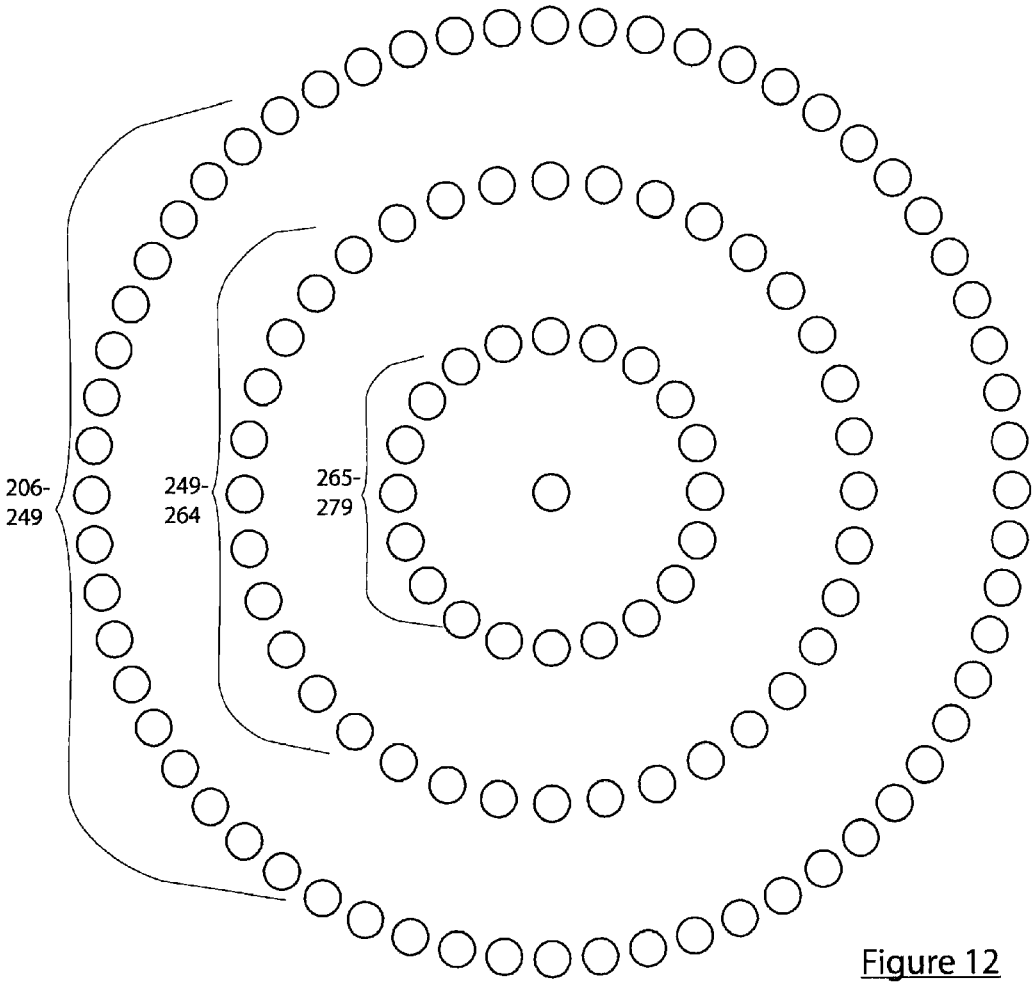
FIG. 12 illustrates a ceiling aperture configuration where falling visual field objects may be timed to produce superpositioned waves in a fluid.

For example, if a visual field object is dropped from hole 200 of FIG. 12 after the object strikes the fluid the wavefront of the circular wave expanding from the impact site will spread in all directions, including directly towards the center, directly below where hole 202 of FIG. 12 is located, like the effect of an expanding circular wave seen when a pebble drops into a pool of water. If at precisely the same time, visual field objects are dropped from holes 200 and 204 because it is visual field objects that are dropping and because the visual field objects being dropped are the same size, the wavefront expanding from the impact site of object 200 will look like the wavefront expanding from the impact site of object 204, with both wavefronts having the same amplitude. These two wavefronts will pass through each other in the center of the circle represented by apertures 206-249 directly below hole 202. And, for a split second the height of the fluid directly below hole 202 will be slightly higher than normal, due to the addition of these two waves as they pass through each other. But because there are only two waves involved, and the height of each of the two waves is not great by the time they reach each other below hole 202, the effect may not be very noticeable. However, if visual field objects 206-249 are all dropped at the same time, each wavefront is the same as in the case where only one or two visual field objects were dropped, but now when all 44 wavefronts pass through each other below hole 202, the result is quite dramatic. Because, while the amplitude of any one of the waves is not great, for that moment when they all pass through each other below hole 202, 44 small waves add together to create one large spike of fluid, substantially higher than the normal height of the fluid at that point. This effect can be maximized by altering the viscosity of the fluid in the pool.

In another embodiment, by timing the drops of the visual field objects, a resonance condition can be established in a fluid pool A resonance condition in a fluid pool occurs when a wave, call it Wave I, traveling in one direction is reinforced (its amplitude made larger) by another wave, call it Wave II, whose location, direction, and speed are the same as Wave I. If additional waves are introduced in such a way that their location, direction, and speed also reinforce Wave I, then the amplitude of Wave I will continue to increase (so long as the reinforced wave remains linear), creating a resonance condition. This resonance condition can be created in the fluid pool of an embodiment with the precision dropping of its visual field objects.

Consider holes 249-264 and 265-279 in FIG. 12. If a visual field object is dropped from each of holes 249-264 at the same time, then after impact with the fluid, the resulting waves will create a circular wave concentric to and in the direction of holes 265-279. This wave (Wave "III") will travel across the pool at a given speed. Now, at some time after the visual field objects have dropped from holes 249-264, objects are dropped from each of the holes 265-279, all at the same time. If this drop time is properly timed, then the visual field objects dropped from holes 265-279 can be made to land directly on top of Wave IV, thereby reinforcing it. Now Wave IV is slightly larger than it was originally and headed toward and into the right wall of the pool enclosure. If the walls of the pool are inelastic, then Wave IV will reflect off the wall (remaining parallel to holes 249-264 and 265-279) and continue back towards the left wall. If, as Wave III continues, visual field objects continue to drop, at precisely coordinated times from holes 265-279-249-264, then a resonance condition will be created, where Wave III is repeatedly reinforced, leading to a large wave traveling back and forth across the fluid pool. This result will be unexpected by viewers of embodiments of the system because the plane waves created by any individual line drop are relatively small in amplitude, and it is not apparent that a large amplitude wave can be created from these initial small amplitude waves.

Finally, music can be provided coordinated with dropping (or launch returning) visual field objects to make a viewer's experience an auditory as well as a visual experience. For example, a popular song could be played during a drop sequence preferably with a rhythm corresponding to the dropping objects, adding to the viewer experience. Alternatively, a piece of music could be written specifically for a drop sequence, where different tones/notes correspond to different drop holes, release times, or fall durations. In yet another alternative, a sound generator could be used to produce certain sounds corresponding to one or more events in the operation of the apparatus, such as an object emerging from a ceiling aperture, an object traversing the visual field, or an object reaching the bottom of the visual field.

While the above disclosure demonstrates selected embodiments of the system, those skilled in the art will understand there are many parameters of the apparatus that can be changed while remaining within the spirit of the disclosure. In view of the many possible embodiments to which the principles of the present discussion may be applied, it should be recognized that the embodiments described herein with respect to the figures are meant to be illustrative only and should not be taken as limiting the scope of the claims. Therefore, apparatus as described herein contemplate all such embodiments as may come within the scope of the following claims and equivalents thereof.

The apparatus described herein may include a processor, a memory for storing program data to be executed by the processor, a permanent storage such as a disk drive, a communications port for handling communications with external devices, and user interface devices, including a display, touch panel, keys, buttons, etc. When software is involved, the software may be stored as program instructions or computer readable code executable by the processor on a non-transitory computer-readable media such as magnetic storage media (e.g., magnetic tapes, hard disks, floppy disks), optical recording media (e.g., CD-ROMs, Digital Versatile Discs (DVDs), etc.), and solid state memory (e.g., random-access memory (RAM), read-only memory (ROM), static random-access memory (SRAM), electrically erasable programmable read-only memory (EEPROM), flash memory, thumb drives, etc.). The computer readable recording media may also be distributed over network coupled computer systems so that the computer readable code is stored and executed in a distributed fashion. This computer readable recording media may be read by the computer, stored in the memory, and executed by the processor.

The disclosed embodiments may be described in terms of various processing steps which may be realized by any number of hardware and/or software components configured to perform as described. For example, the disclosed embodiments may employ various integrated circuit components, e.g., memory elements, processing elements, logic elements, look-up tables, and the like, which may carry out a variety of functions under the control of one or more microprocessors or other control devices. Similarly, where the elements of the disclosed embodiments are implemented using software programming or software elements, the disclosed embodiments may be implemented with any programming or scripting language such as C, C++, JAVA®, assembler, or the like, with the various algorithms being implemented with any combination of data structures, objects, processes, routines or other programming elements. Functional aspects may be implemented in algorithms that execute on one or more processors. Furthermore, the disclosed embodiments may employ any number of conventional techniques for electronics configuration, signal processing and/or control, data processing and the like. Finally, the steps of all methods described herein may be performed in any suitable order unless otherwise indicated herein or otherwise clearly contradicted by context.

For the sake of brevity, conventional electronics, control systems, software development and other functional aspects of the systems (and components of the individual operating components of the systems) may not be described in detail. Furthermore, where connecting lines are shown, the lines are intended to represent exemplary functional relationships and/or physical or logical couplings between the various elements. It should be noted that many alternative or additional functional relationships, physical connections or logical connections may be present in a practical device. The words "mechanism", "element", "unit", "structure", "means", "device", "controller", and "construction" are used broadly and are not limited to mechanical or physical embodiments, but may include software routines in conjunction with processors, etc.

The use of the terms "a" and "an" and "the" and similar referents in the context of describing the embodiments of the invention are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated or otherwise clearly contradicted by context. The use of any and all examples, or exemplary language (e.g., "such as") provided herein, is intended merely to better illustrate the invention and does not pose a limitation on the scope of the invention unless otherwise claimed. Finally, it should be understood that the illustrated embodiments are exemplary only, and should not be taken as limiting the scope of the invention.

Table of Reference Characters

| Character No. | Character Name |
|---|---|
| 10 | falling pattern imagery system |
| 12 | upper section of imagery system |
| 14 | lower section of imagery system |
| 16 | hopper |
| 18 | bottom panel of hopper |
| 19 | top surface of bottom panel of hopper |
| 20 | sidewalls of hopper |
| 21 | top of hopper |
| 22 | apertures in bottom panel of hopper |
| 22a | launch apertures |
| 24 | facade or ceiling |
| 24a | near vertical facade |
| 24b | facade or ceiling for receiving launched objects |
| 25 | central aperture |
| 26 | apertures in facade or ceiling |
| 26a-26k | selected apertures in ceiling |
| 27 | return apertures |
| 27A-27C | concentric circles of apertures |
| 28 | hollow ducts |

-continued

Table of Reference Characters

| Character No. | Character Name |
|---|---|
| 30 | top ends of hollow ducts |
| 31 | triangular ceiling aperture configuration |
| 32 | bottom ends of hollow ducts |
| 33 | apertures of triangular ceiling configuration |
| 34 | mixer device |
| 35 | mixer device motor |
| 36 | visual field object |
| 36a | visual field objects at rest in duct |
| 36b | released and falling visual field object |
| 36c | bottommost visual field object |
| 36d | next visual field object |
| 36e | ferromagnetic visual field object |
| 36f | launched visual field object |
| A | direction of falling single field object |
| 37a | apertures of rectangular ceiling configuration |
| 38 | bottom edge of ducts |
| 39 | paddles attached to motor shaft |
| 40 | visual field of imagery system |
| 41 | control bore |
| 42 | gating device |
| 43 | solenoid |
| 44 | solenoid plunger |
| 45 | rectangular ceiling aperture configuration |
| 46 | solenoid spring |
| 48 | body of solenoid |
| 49 | solenoid "C" clamp |
| 50 | motor |
| 50A/50B | solenoid wires |
| 52 | paddle wheel |
| 53 | shaft of motor |
| 54a-54d | paddle wheel vanes |
| 56 | duct wall opening |
| 60 | receptacle |
| 61 | receptacle platform |
| 62 | fluid |
| 64 | top receptacle |
| 65 | bottom of receptacle |
| 66 | receptacle cover |
| 68 | apertures in receptacle cover |
| 70 | recirculating unit |
| 72 | ramps |
| 74 | tubes |
| 76 | distal ends |
| 78 | ramp solenoid |
| 80 | rectangular array of apertures |
| 82 | receptacle platform |
| 84 | receptacle apertures |
| 86 | launch apertures |
| 90 | Ramp of launch apparatus |
| 92 | Launch apparatus gating device |
| 94 | Proximal end of launch device ramp |
| 96 | Launch device tube |
| 98 | Distal end of launch device tube |
| 100 | computer/microprocessor |
| 101 | compressed air tank |
| 102 | release valve |
| 104 | gating device "on" step |
| 105 | proximal end of launch tubes |
| 106 | gating device "off" step |
| 108 | visual field object release step |
| 110 | computer/microprocessor/microcontroller |
| 112 | hopper mixer on/off control step |
| 113 | solenoid/paddle wheel motor control |
| 114 | optional launch control step |
| 114, 115 | on/off conditions of motor control |
| 116 | pressurized air "on" step |
| 118 | pressurized air "off" step |
| 120 | launch return step |
| 119, 121 | objects released and objects held |
| 122 | launch resist step |
| 123 | hopper mixer control |
| 124 | pneumatic launch control |
| 126, 128 | on/off conditions of launch control |
| 130, 132 | objects released and objects held |
| 134 | light source |

-continued

Table of Reference Characters

| Character No. | Character Name |
|---|---|
| 136 | lens (may be light pipe) |
| 138 | collimated light |
| 140 | electromagnet |

What is claimed is:

1. An apparatus for dropping multiple visual field objects into a visual field to create imagery comprising:

an upper section, a lower section, and a visual field disposed between the upper and lower sections;

a container for receiving and holding visual field objects disposed in the upper section having a plurality of apertures distributed across its bottom;

a façade having a plurality of apertures in alignment with the apertures distributed across the container bottom;

a plurality of hollow ducts extending between the container apertures and the façade apertures for conveying the visual field objects from the container to the façade apertures;

gating devices located in the ducts for releasing the visual field objects from the ducts to produce imagery in the visual field;

a receptacle for receiving the visual field objects after they pass through the visual field;

a recirculating unit for returning visual field objects from the receptacle to the container disposed in the upper section; and a control unit to operate the gating devices.

2. The apparatus of claim 1 in which the imagery is chosen from the group consisting of stationary imagery, dynamic imagery, abstract imagery, and manifest imagery.

3. The apparatus of claim 1 in which the visual field objects are chosen from the group consisting of spheres, cubes, cylinders, pyramids, toruses, hemispheres, prisms, star-shapes, pill shapes and cone shapes.

4. The apparatus of claim 1 in which the visual field objects are made of a material chosen from the group consisting of metal, plastic, wood, rubber, glass, and foam.

5. The apparatus of claim 1 in which the visual field objects are made of a ferromagnetic material.

6. The apparatus of claim 1 in which the images are in linear three-dimensional form or full three-dimensional form.

7. The apparatus of claim 1 in which the container apertures are arranged in a configuration chosen from the group consisting of random configurations, geometric shapes, regular or irregular matrices, and outlines of visual objects.

8. The apparatus of claim 1 in which the façade is at any desired angle greater than 90° from the vertical.

9. The apparatus of claim 1 including a mixing device for keeping the visual field objects circulating within the container.

10. The apparatus of claim 9 in which the mixing device is a stirring-type device or a vibratory-type device.

11. The apparatus of claim 1 in which the ducts extend through the façade.

12. The apparatus of claim 1 in which the gating devices are chosen from the group consisting of solenoids, paddle wheels mounted to controllable motors, butterfly valves, partial ball valves, and magnetic valves.

13. The apparatus of claim 1 in which second gating devices are mounted in the ducts.

14. The apparatus of claim 1 in which the receptacle contains a fluid.

15. The apparatus of claim 1 in which the recirculating unit is chosen from the group consisting of screw conveyors, belt conveyors, and bucket conveyors.

16. The apparatus of claim 1 in which the receptacle includes apertures for receiving visual field objects that pass through the visual field and launchers for propelling the visual field objects back through the visual field to the container disposed in the upper section.

17. The apparatus of claim 16 in which the launcher comprises an inclined ramp for collecting visual field objects, a gating device for controlling the movement of the visual field objects from the ramp, a tube for receiving visual field objects released from the ramp, a compressed air source, and a compressed air release valve for propelling visual field objects from the tube.

18. The apparatus of claim 1 in which the hollow ducts do not extend the entire distance between the container apertures and the façade apertures.

19. An apparatus for dropping multiple objects into a visual field to create imagery comprising:

an upper section, a lower section, and a visual field disposed between the upper and lower sections;

a container for receiving and holding visual field objects disposed in the upper section having a plurality of apertures distributed across its bottom;

a façade having a plurality of apertures in alignment with the apertures distributed across the container bottom;

a plurality of hollow ducts extending between the container apertures and the façade apertures for conveying visual field objects from the container to the façade apertures;

gating devices located in the ducts for releasing the visual field objects from the ducts to produce imagery in the visual field;

a receptacle for receiving the visual field objects after they pass through the visual field, the receptacle having apertures for receiving visual field objects received in the receptacle and launchers for propelling the visual field objects back through the visual field to the container disposed in the upper section; and a control unit to operate the gating devices and the launchers to produce the imagery and to propel the visual field objects to the container disposed in the upper section.

* * * * *